US006032387A

United States Patent [19]

Johnson

[11] Patent Number: 6,032,387

[45] Date of Patent: Mar. 7, 2000

[54] AUTOMATED TIGHTENING AND LOOSENING SHOE

[76] Inventor: Gregory G. Johnson, 3417 Longfellow Ave. South, Minneapolis, Minn. 55407

[21] Appl. No.: 09/288,476

[22] Filed: Apr. 8, 1999

Related U.S. Application Data

[63] Continuation-in-part of application No. 09/048,772, Mar. 26, 1998.

[51] Int. Cl.[7] ..... A43C 11/00; A43B 5/04

[52] U.S. Cl. ..... 36/50.1; 36/118.1

[58] Field of Search ..... 36/50.1, 50.5, 36/51, 118.1, 118.2

[56] References Cited

U.S. PATENT DOCUMENTS

| | | | |
|---|---|---|---|
| 4,654,985 | 4/1987 | Chalmers | 36/118.1 |
| 4,811,503 | 3/1989 | Iwama | 36/118.1 |
| 4,942,680 | 7/1990 | Benetti | 36/118.1 |
| 5,205,055 | 4/1993 | Harrell | 36/50.1 |
| 5,259,094 | 11/1993 | Zepeda | 36/50.1 |
| 5,791,068 | 8/1998 | Bernier et al. | 36/50.1 |

*Primary Examiner*—B. Dayoan
*Attorney, Agent, or Firm*—Hugh D. Jaeger

[57] ABSTRACT

An automated tightening and loosening shoe with rigid, semi-rigid or flexible polymer bands functioning as laces, and a tightening mechanism which operates in one direction to cause automatic tightening of the rigid, semi-rigid or flexible polymer bands to tighten the automated tightening and loosening shoe about a wearer's foot, and which operates in a reverse or loosening direction to cause automatic loosening of the rigid, semi-rigid or flexible polymer bands so that the automated tightening and loosing shoe can be removed from the wearer's foot.

25 Claims, 17 Drawing Sheets

AUTOMATED TIGHTENING AND LOOSENING SHOE

CROSS REFERENCES TO CO-PENDING APPLICATIONS

This patent application is a continuation-in-part of Ser. No. 09/048,772, entitled "AUTOMATED TIGHTENING SHOE", filed on Mar. 26, 1998 by the same inventor.

BACKGROUND OF THE INVENTION

1. Field of the Invention

The present invention pertains to a shoe and, more particularly, to an automated tightening and loosening shoe. The shoe is provided with an automated tightening system including a tightening mechanism which operates in one direction to cause automatic tightening of the shoe about a wearer's foot, and which operates in a reverse or loosening direction to cause automatic loosening of the shoe so that it can be removed from the wearer's foot. The invention is chiefly concerned with an automated tightening and loosening shoe of the sport or athletic shoe variety, but the principles of the invention are applicable to shoes of many other types and styles.

2. Description of the Prior Art

Shoes which incorporate an automated tightening system are known in the prior art. However, none of the automated tightening systems heretofore devised has been entirely successful or satisfactory. Major shortcomings of the automated tightening systems of the prior art are that they fail to tighten the shoe from both sides so that it conforms snugly to the wearer's foot, and that they lack any provision for effecting automatic loosening of the shoe when it is desired to remove the shoe from the wearer's foot. Aspects of prior art automated tightening systems contributing to their lack of success and satisfaction have been (1) complexity, in that they involve numerous parts; (2) the inclusion of expensive parts, such as small electric motors; (3) the use of parts needing periodic replacement, e.g. a battery; and (4) the presence of parts requiring frequent maintenance. These aspects, as well as others not specifically mentioned, indicate that considerable improvement is needed in order to attain an automated shoe that is completely successful and satisfactory.

SUMMARY OF THE INVENTION

The general purpose of the present invention is to provide an automated shoe that is devoid of the various shortcomings and drawbacks characteristic of shoes of this sort which exist in the prior art.

Accordingly, the primary objective of the present invention is to produce an automated tightening and loosening shoe, especially a sport or athletic shoe, that tightens snugly about the wearer's foot from both sides and that has an automated loosening capability. It is a further objective of the present invention to attain the primary objective by providing an automated tightening system which requires no complex or expensive parts, and which includes no parts that need frequent maintenance or periodic replacement. Another objective of the present invention is to provide an automated tightening and loosening shoe which is easy to operate and trouble-free in use.

The foregoing general purpose and objectives of the present invention are fully achieved by the automated tightening and loosening shoe of the present invention which, briefly and in accordance with the preferred embodiment, comprises a sport or athletic shoe having a sole, an integral body member or shoe upper constructed of any common sport or athletic shoe material or materials and including a toe, a heel, and a tongue. The integral body member or shoe upper has a gap at the area of the tongue of the shoe, and a reinforced lacing pad having a number of pairs of anchor button holes is provided around the periphery of the gap. Rigid, semi-rigid or flexible polymer bands functioning similarly to laces and corresponding in number to the number of pairs of anchor button holes formed in the lacing pad circumscribe the integral body member. The rigid, semi-rigid or flexible polymer bands have portions confined within stitched slots located internally in the integral body member on both sides of the gap, and free ends which emerge from the stitched slots, cross over each other above the shoe tongue, and attach to respective pairs of anchor button holes by means of anchor buttons provided on their tips. The topmost band is attached to the shoe tongue by a lace containment loop. The midportions of the rigid, semi-rigid or flexible polymer bands are located in a chamber formed in the sole of the shoe and are connected to each other by intermediate springs which in turn are connected to an actuating cable leading to and incorporated into a tightening mechanism located partly in the sole but primarily in the heel of the shoe. The intermediate springs serve to distribute proper tension to the rigid, semi-rigid or flexible polymer bands during the tightening process, and also aid in restoring the rigid, semi-rigid or flexible polymer bands to the loosened condition. The tightening mechanism includes the actuating cable, a ratchet reel rotatable on an axle, a spring-biased pawl for engaging the teeth of the ratchet reel step-by-step as the ratchet reel rotates in the tightening direction so as to prevent rotation of the ratchet reel in the reverse or loosening direction, an actuating lever with teeth for engaging the teeth of the ratchet reel to move the ratchet reel in the tightening direction, and a disengage lever for releasing the pawl and thereby permitting the ratchet reel to rotate in the loosening direction. Retracting elastic bands are provided around the portions of the topmost rigid, semi-rigid or flexible polymer band which reside in the two topmost stitched slots positioned to either side of the gap for aiding in restoring the rigid, semi-rigid or flexible polymer bands to the loosened condition upon release of the ratchet reel by the disengage lever. The rigid, semi-rigid or flexible polymer bands themselves possess a spring memory which further aids in advancing them to the loosened condition.

In operation, rotation of the ratchet reel in the tightening direction by the actuating lever causes the actuating cable to exert a pull on the rigid, semi-rigid or flexible polymer bands and intermediate springs, whereby the rigid, semi-rigid or flexible polymer bands tighten the integral body member from both sides snugly about the wearer's foot. At the same time, the retracting elastic bands are stretched. Release of the ratchet reel by the disengage lever allows the ratchet reel to rotate in the reverse or loosening direction under the combined influence of the retracting elastic bands and intermediate springs, thereby restoring the rigid, semi-rigid or flexible polymer bands to their original position and, thus, loosening the integral body member so that the shoe can be removed from the wearer's foot.

The entire operation just described can be accomplished without the use of the hands simply by tilting the shoe backwardly and tapping the actuating lever, which extends downwardly out of the posterior portion of the shoe sole, on the ground, floor or other surface to tighten the shoe; and by manipulating the disengage lever, which protrudes rearwardly from the shoe heel, by the toe of the companion shoe in order to loosen the shoe.

Alternate embodiments of the automated tightening and loosening shoe involve variations to the tightening mechanism utilized in the preferred embodiment. Each of the various tightening mechanisms of the alternate embodiments includes a ratchet cable which is engaged by a pawl that obstructs movement of the ratchet cable in the loosening direction during tightening. A first alternate embodiment employs a push plate and actuating lever for advancing the ratchet cable in the tightening direction when the heel of the shoe is tapped on the ground, the floor or other such surface; a second alternate embodiment employs a pull tab or loop connected to the forward end of the ratchet cable for pulling the ratchet cable in the tightening direction; and a third alternate embodiment combines the features of the first and second alternate embodiments.

Although all of the aspects and features of the automated tightening and loosening shoe enumerated above are important to the attainment of the purpose and objectives of the present invention and contribute to the overall superior quality, easy operation, and trouble-free performance of the shoe, certain ones are especially significant and merit special recognition.

One such significant aspect and feature of the present invention is the arrangement of crisscrossed or parallel parts, such as laces or bands, which effects tightening of the automated tightening and loosening shoe from both sides, thus producing a snug fit about the wearer's foot.

Another such significant aspect and feature of the present invention is the "hands free" operating capability of several of the tightening mechanisms in both the tightening and loosening directions.

Still another such significant aspect and feature of the present invention is the pair of intermediate springs that provide for proper distribution of tension on every rigid, semi-rigid or flexible polymer band during the tightening process and that also aid in the loosening process.

Yet another such significant aspect and feature of the present invention is the provision of the retracting elastic bands which impart a recoiling force to the rigid, semi-rigid or flexible polymer bands upon release of the various tightening mechanisms and thereby cause loosening of the automated tightening and loosening shoe.

A still further such significant aspect and feature of the present invention is the spring memory characteristic of the rigid, semi-rigid or flexible polymer bands which aids in the restoration of the rigid, semi-rigid or flexible polymer bands to the loosened condition.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
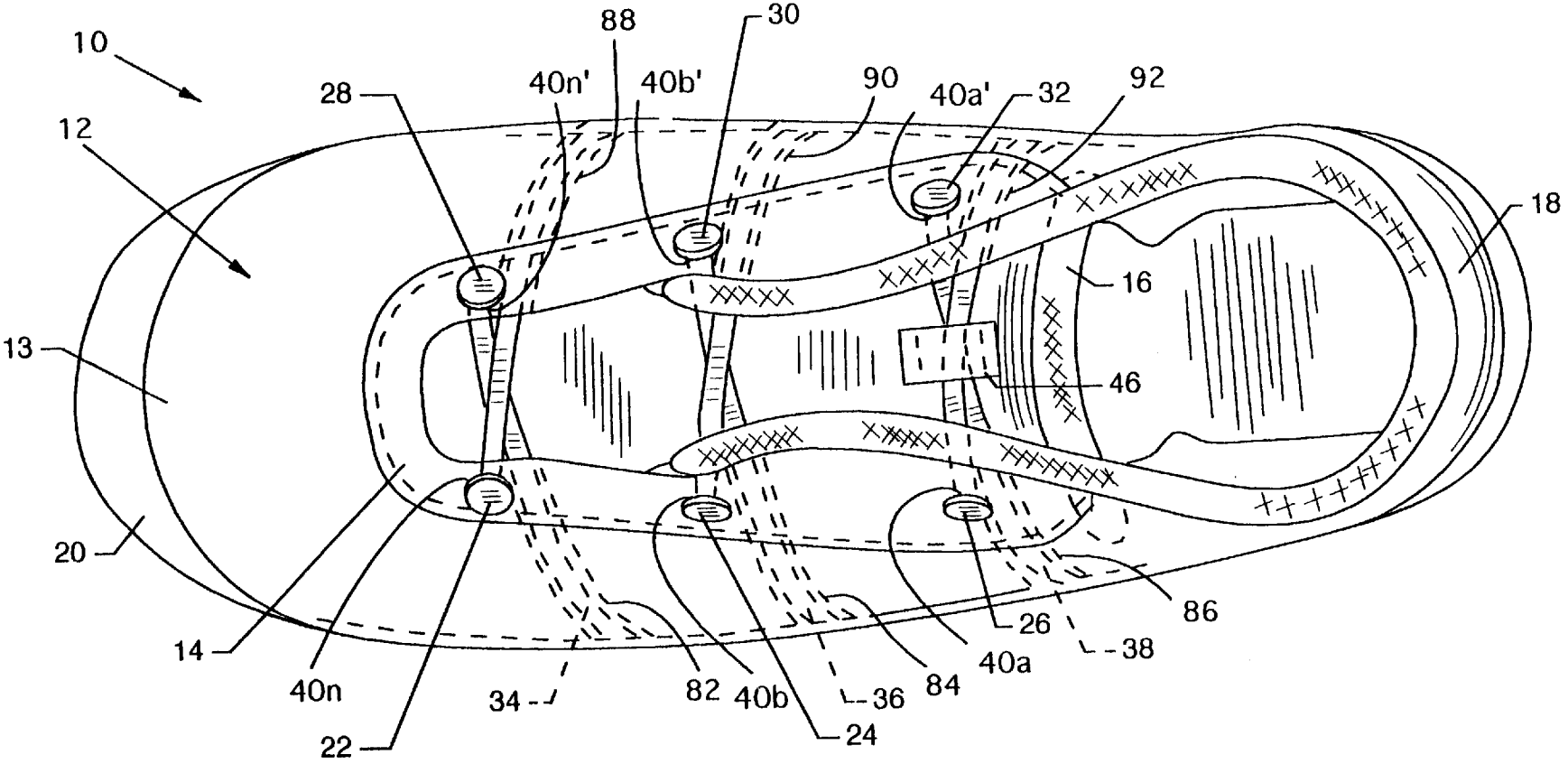
FIG. 1 illustrates a top view of an automated tightening and loosening shoe, the present invention, in the closed condition.
Figure 2:
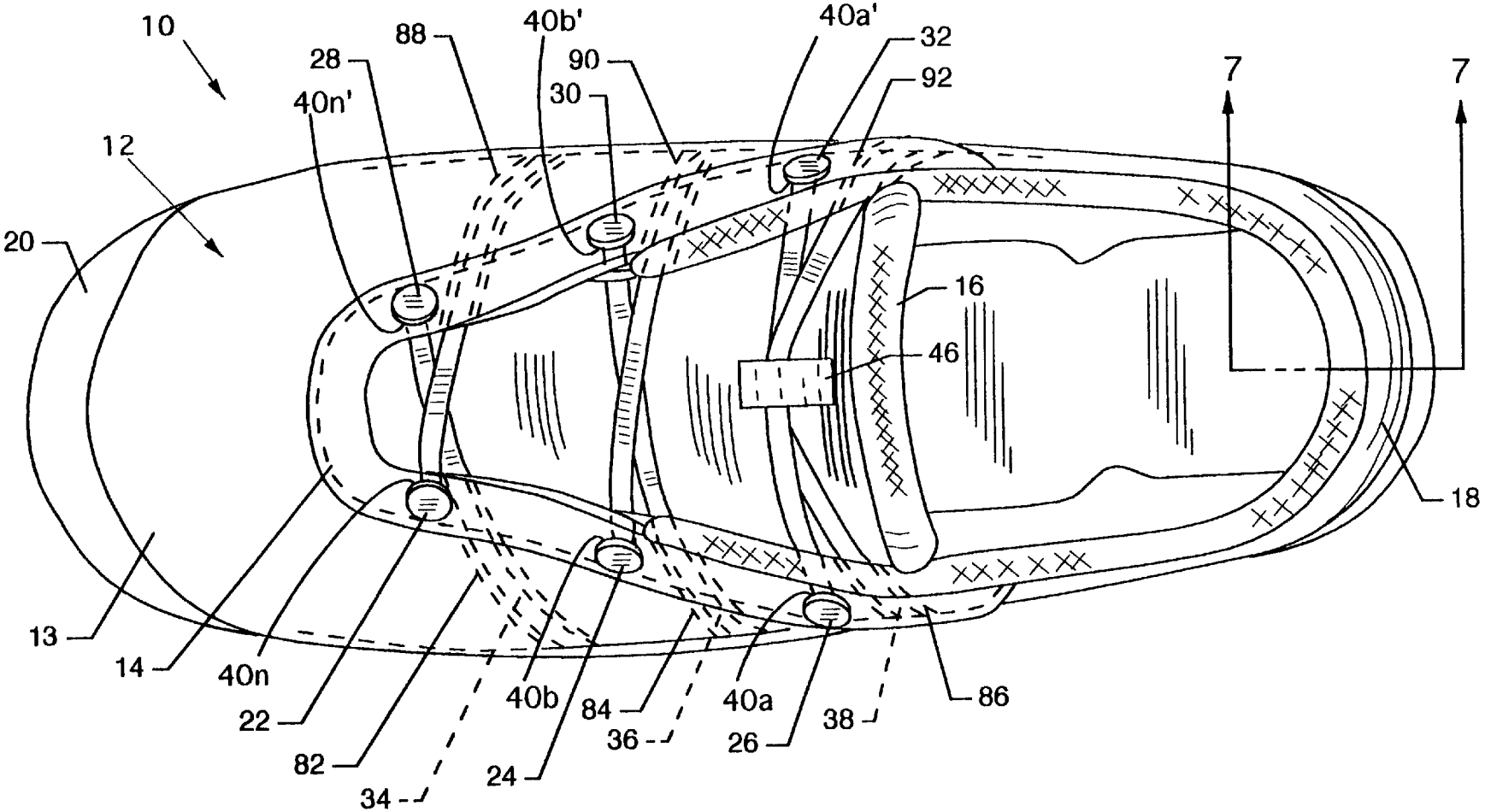
FIG. 2 illustrates a top view of the automated tightening and loosening shoe in the open condition.

FIG. 1 illustrates a top view of an automated tightening and loosening shoe 10 in the closed condition, and FIG. 2 illustrates a top view of the automated tightening and loosening shoe 10 in the open condition. Although the automated tightening and loosening shoe may be of many types and styles, it is particularly desirable to have a sport or athletic shoe that features automated tightening; therefore, it is that variety of shoe which has been selected to illustrate the invention.

The shoe 10, as illustrated, is a sport or athletic shoe having a sole 20, an integral body member or shoe upper 12 constructed of any common sport or athletic shoe material or materials and including a toe 13, a heel 18, and a tongue 16. The integral body member 12 has a gap at the area of the shoe tongue 16; and a reinforced lacing pad 14, also formed of any common sport or athletic shoe material or materials, is attached to the integral body member 12 around the periphery of the gap. The reinforced lacing pad 14 contains any number of pairs of anchor button holes. In the form illustrated, the reinforced lacing pad 14 has three pairs of anchor button holes identified as 40*a*–40*a*', 40*b*–40*b*' and 40*n*–40*n*'. Rigid, semi-rigid or flexible polymer bands 34, 36 and 38 functioning similarly to laces and corresponding in number to the number of pairs of anchor button holes 40*a*–40*a*', 40*b*–40*b*' and 40*n*–40*n*' are provided. Thus, in the illustrated embodiment having three pairs of anchor button holes 40*a*–40*a*', 40*b*–40*b*' and 40*n*–40*n*', three rigid, semi-rigid or flexible polymer bands 34, 36 and 38, one for each pair of anchor button holes 40*a*–40*a*', 40*b*–40*b*' and 40*n*–40*n*' are provided. The rigid, semi-rigid or flexible polymer bands 34, 36 and 38 circumscribe the shoe interior through sole 20 at the bottom and through stitched slots 82, 84, 86, 88, 90 and 92 within the integral body member 12 at the sides of the shoe 10, emerge from the upper ends of the stitched slots 82, 84, 86, 88, 90 and 92, cross over each other above the shoe tongue 16, and attach to respective pairs of anchor button holes 40*a*–40*a*', 40*b*–40*b*' and 40*n*–40*n*' by means of anchor buttons 22, 24, 26, 28, 30 and 32 affixed on their tips. The topmost band 38 is attached to the shoe tongue 16 by a lace containment loop 46. In the alternative and also in embodiments which follow, the rigid, semi-rigid or flexible polymer bands 34, 36 and 38 and corresponding stitched slots 82, 84, 86, 88, 90 and 92 can be fashioned and arranged in parallel fashion in lieu of crossing over fashion, as previously described, and shall not be deemed to limiting to the scope of the invention.

Figure 3:
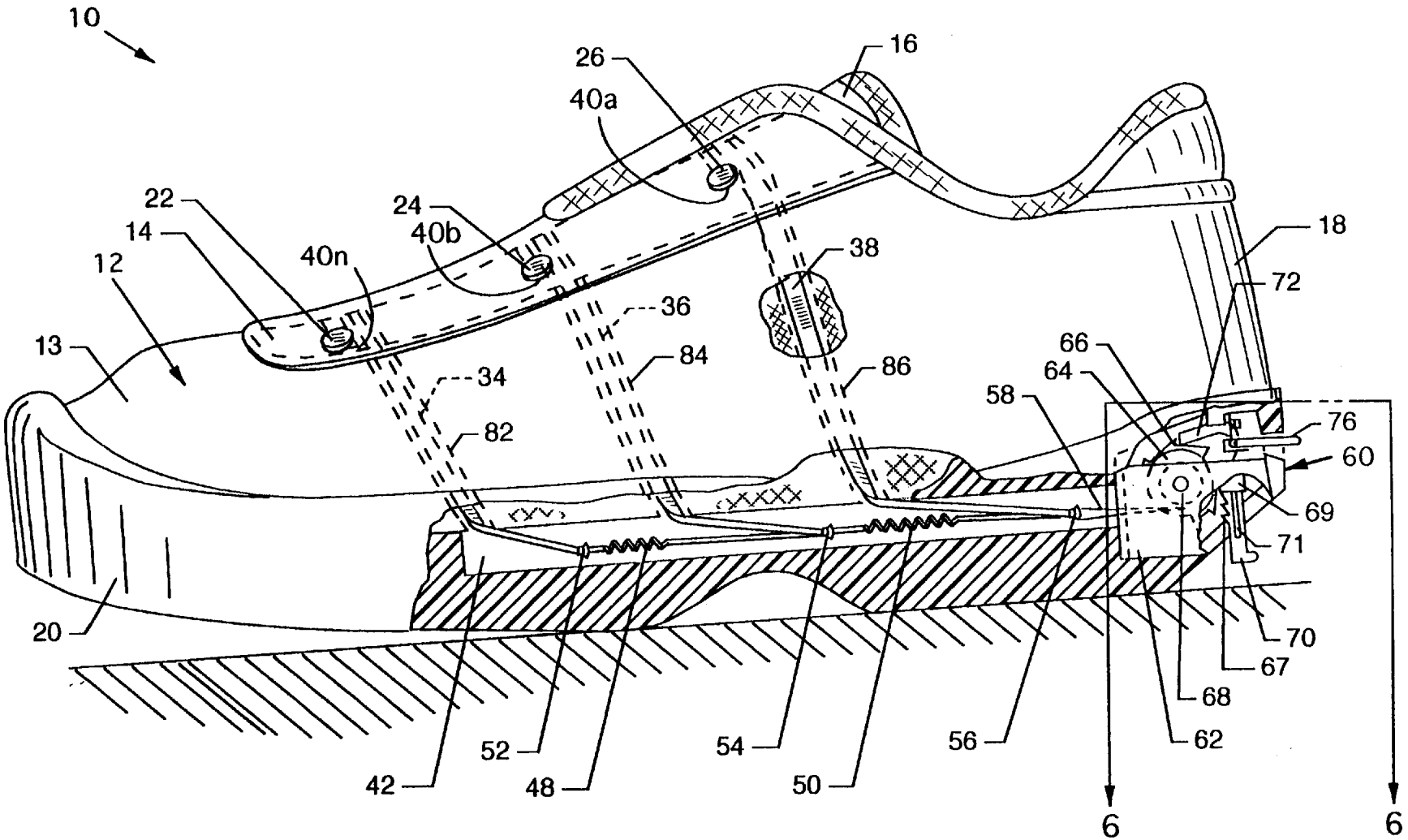
FIG. 3 illustrates a side view of the automated tightening and loosening shoe with parts in section and portions cut away to reveal internal details.

FIG. 3 illustrates a side view of the shoe 10 with parts in section and portions cut away to reveal internal details, where all numerals which have appeared previously correspond to those elements previously described. The sole 20 is provided with a chamber 42 which communicates with the lower ends of the stitched slots 82, 84, 86, 88, 90 and 92 and which houses the midportions of the rigid, semi-rigid or flexible polymer bands 34, 36 and 38. The midportions of the rigid, semi-rigid or flexible polymer bands 34, 36 and 38 have respective holes 52, 54 and 56 formed therethrough. Two intermediate springs 48 and 50 are suitably and appropriately attached to the rigid, semi-rigid or flexible polymer bands 34, 36 and 38 at the holes 52, 54 and 56 such that spring 48 links rigid, semi-rigid or flexible polymer bands 34 and 36 and spring 50 links rigid, semi-rigid or flexible polymer bands 36 and 38. Rigid, semi-rigid or flexible polymer band 38 is further connected to an actuating cable 58 which in turn leads to and is incorporated into a tightening mechanism 60. The tightening mechanism 60, described later in detail, is located in the rearward end of the chamber 42 at the shoe heel 18. The rearward end of chamber 42 opens to the bottom and rear of the shoe 10 to provide for two protruding elements of the tightening mechanism 60 which extend beyond the external surface of the shoe 10: in particular, an actuating lever 70 and a disengage lever 76.

Figure 4:
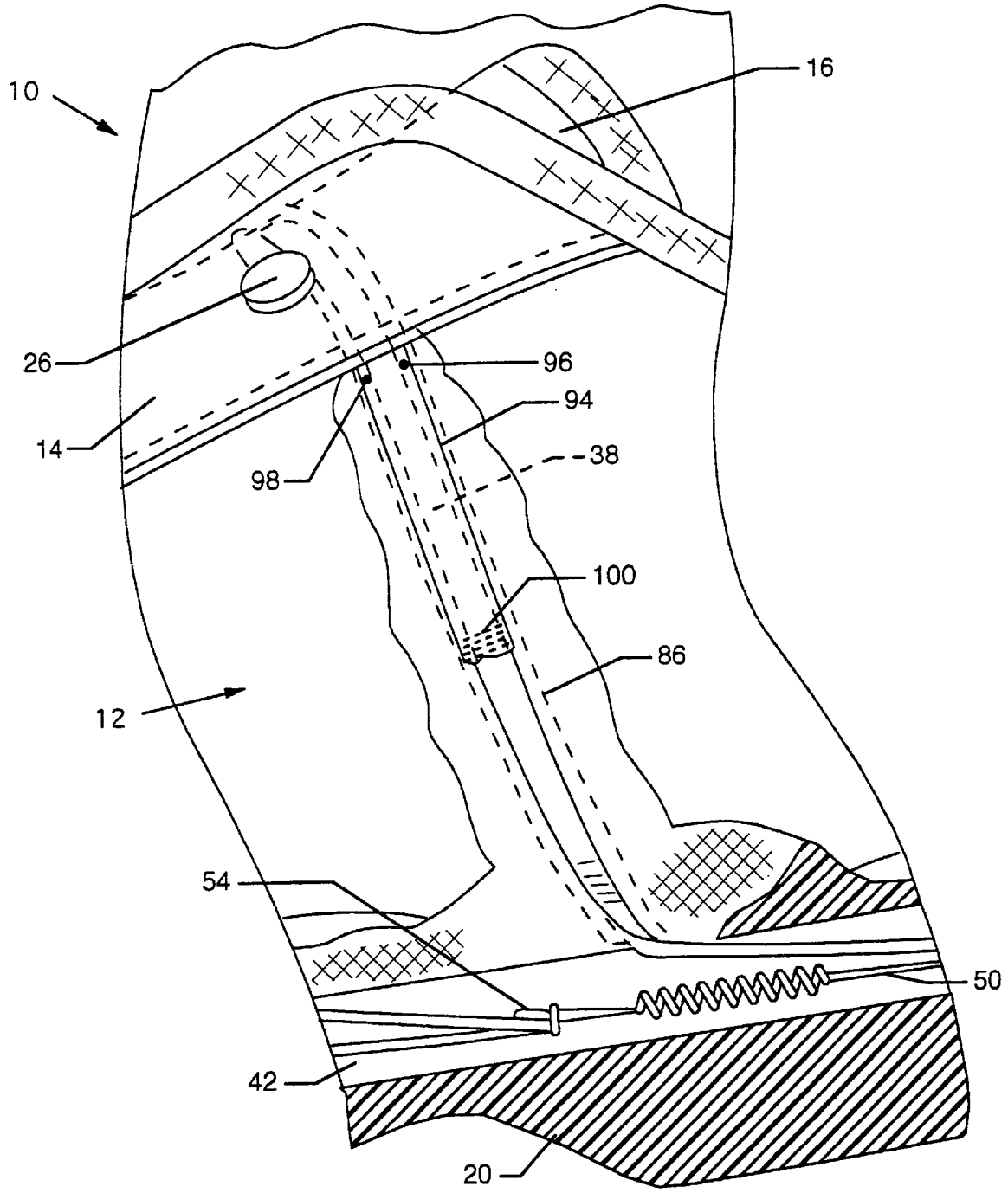
FIG. 4 illustrates an enlarged fragmentary side view, with parts in section and portions cut away, of a portion of a stitched slot of the automated tightening and loosening shoe which has a retracting elastic band residing therein.

FIG. 4 illustrates an enlarged fragmentary side view, with parts in section and portions cut away, of a portion of stitched slot 86 of the shoe 10 which has a retracting elastic band 94 residing therein, where all numerals which have appeared previously correspond to those elements previously described. The retracting elastic band 94 is tubular and encircles a segment of the rigid, semi-rigid or flexible polymer band 38 within the stitched slot 86. The retracting elastic band 94 has one of its ends connected to the integral body member 12 immediately adjacent to the reinforced lacing pad 14 by two connector pins 96 and 98, and has the other of its ends connected to the rigid, semi-rigid or flexible polymer band 38 by stitching 100. The retracting elastic band 94 is of such length and extensibility that when the rigid, semi-rigid or flexible polymer band 38 is tightened by the tightening mechanism 60, it is substantially fully extended. As a result, when the tightening mechanism 60 is released, the retracting elastic band 94 contracts. The recoiling force produced by such contraction advances the rigid, semi-rigid or flexible polymer band 38, and corresponding rigid, semi-rigid or flexible polymer bands 36 and 34, and thus loosens the reinforced lacing pad 14 and opens the shoe 10. A companion retracting elastic band 94 is incorporated in identical fashion in the complementary stitched slot 92. Similarly, the intermediate springs 48 and 50 are fully extended when the tightening mechanism 60 is operated in the tightening direction and contract when the tightening mechanism 60 is released. This contraction of springs 48 and 50 also advances the rigid, semi-rigid or flexible polymer bands 34, 36 and 38 and thus assists in the opening of the shoe 10. In addition, the spring memory of the rigid, semi-rigid or flexible polymer bands 34, 36 and 38 themselves assists in their advance to the loosened condition.

Figure 5:
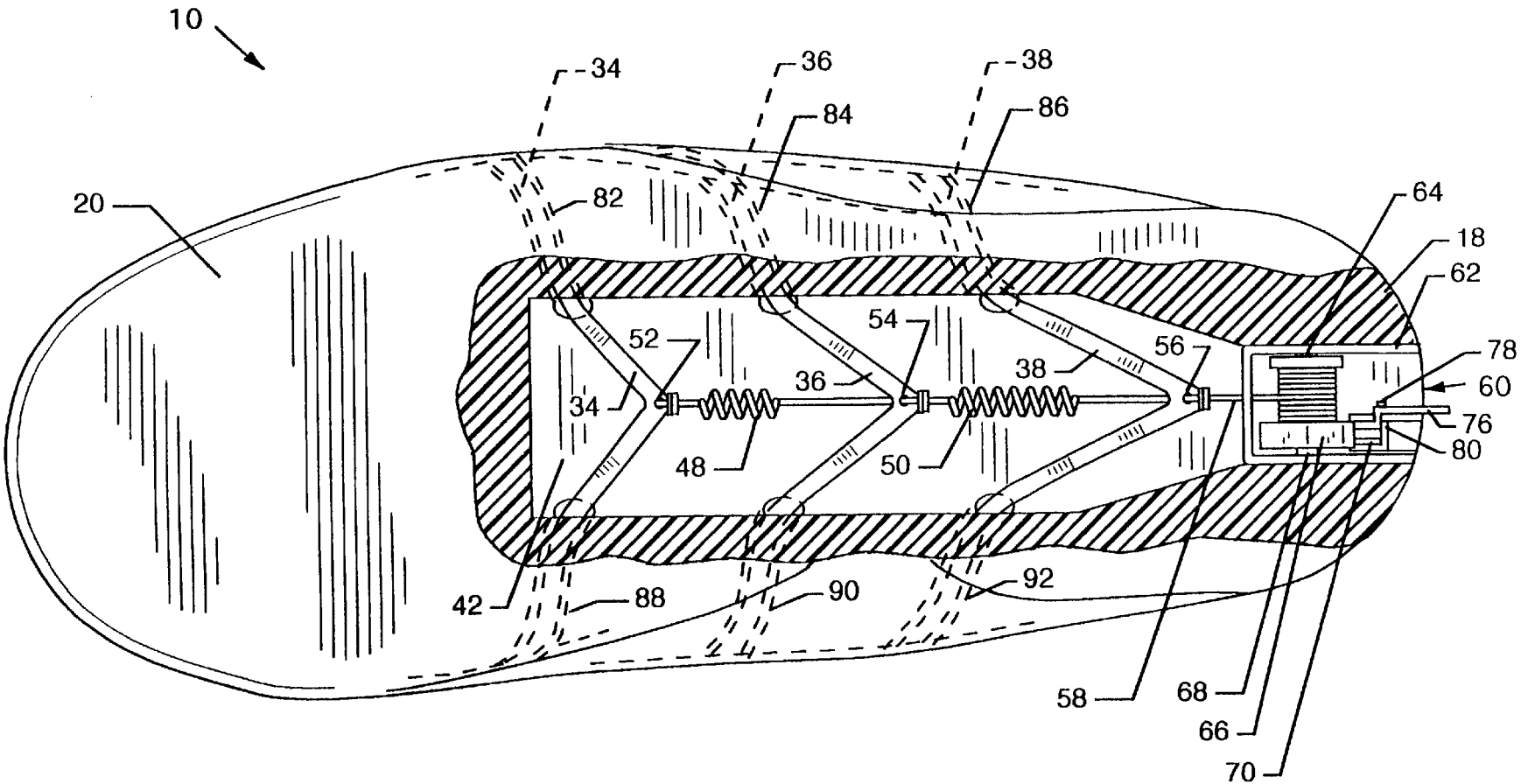
FIG. 5 illustrates a bottom view of the automated tightening and loosening shoe with parts in section and portions cut away to show internal features.

FIG. 5 illustrates a bottom view of the shoe 10 with parts in section and portions cut away to show internal features, where all numerals which have appeared previously correspond to those elements previously described. This view resembles the showing in FIG. 3 but depicts the full width of the chamber 42 in the sole 20 and more clearly portrays the appearance of the midportions of the rigid, semi-rigid or flexible polymer bands 34, 36 and 38 when in their tightened condition. The intermediate springs 48 and 50 play an essential role in the tightening process, since without them, the shoe could not be tightened properly. In order to tighten the shoe 10 snugly and securely about the wearer's foot, it is necessary that the tension administered to the rigid, semi-rigid or flexible polymer bands 34 and 36 be properly distributed. This is accomplished by employing for the spring 48 a spring which is shorter and more resilient than the spring 50.

Figure 6:
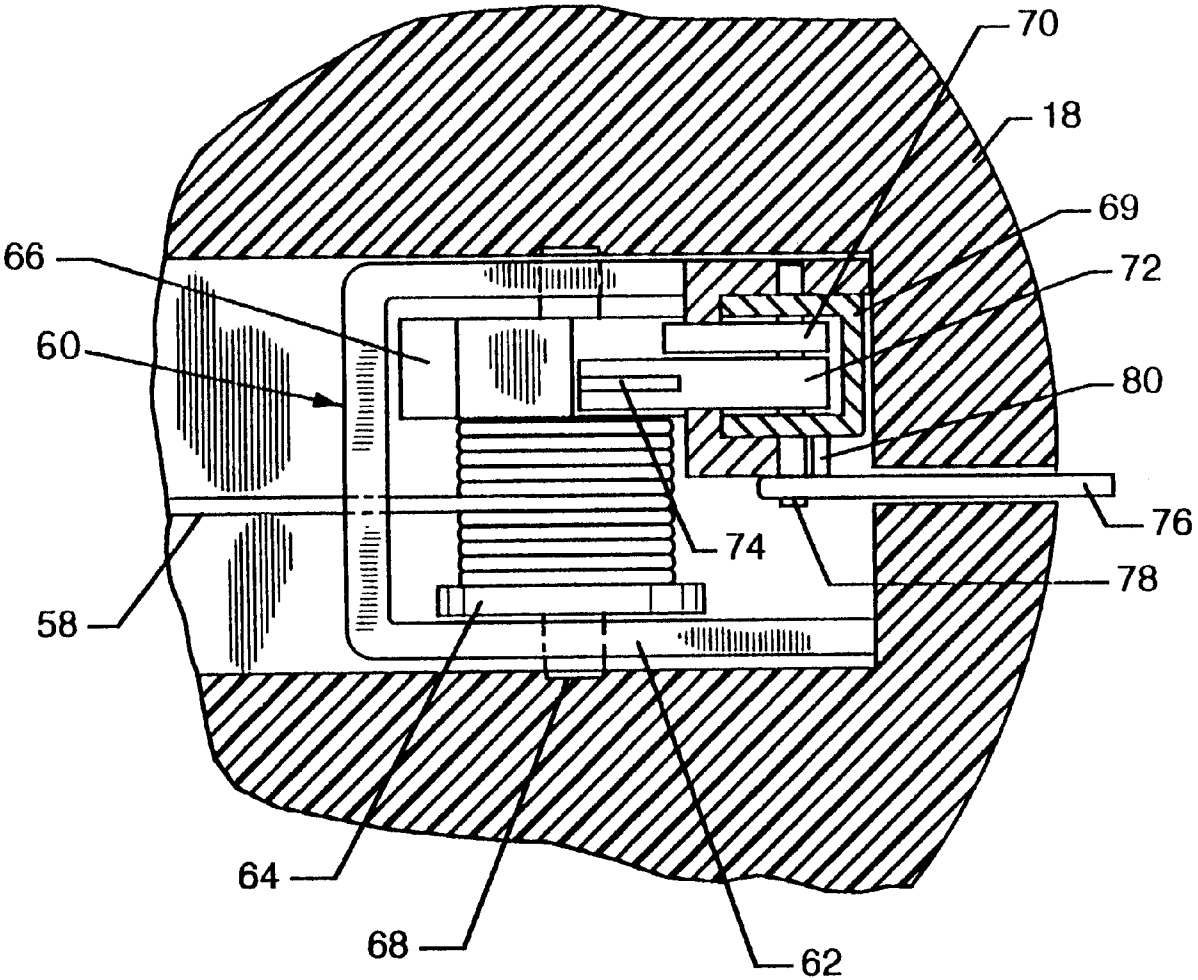
FIG. 6 illustrates a cross sectional view of the tightening mechanism along the line 6—6 of FIG. 3.

FIG. 6 illustrates a cross sectional view of the tightening mechanism 60 along the line 6—6 of FIG. 3, where all numerals which have appeared previously correspond to those elements previously described. With reference also to FIG. 3 and FIG. 5, the tightening mechanism 60 can be seen to be partly encased in a mechanism encasement 62 and to be composed of the actuating cable 58, a ratchet reel 64 having an axle 68 about which it rotates, and at one end a plurality of ratchet teeth 66, an actuating lever encasement 69 containing a spring 102 and an actuating lever 70 having teeth 67 and a slot 71, a ratchet pawl 72 having a posterior arm 80, a pawl slot 73, a pawl spring 74, a disengage lever 76, and an axle 78 about which both the ratchet pawl 72 and the disengage lever 76 pivot. The axle 78 also extends through the slot 71 in the actuating lever 70 and, in concert with the actuating lever encasement 69, serves to guide the actuating lever 70 along its path of movement. The pawl spring 74 biases the ratchet pawl 72 downwardly into the path of the ratchet teeth 66 to obstruct reverse movement of the ratchet reel 64 when tightening of the rigid, semi-rigid or flexible polymer bands 34, 36 and 38 is taking place. The posterior arm 80 of the ratchet pawl 72 underlies the disengage lever 76, such that when engaged thereby, the ratchet pawl 72 pivots about the axle 78 and away from the ratchet teeth 66 to allow the ratchet reel 64 to rotate in the reverse or loosening direction.

MODE OF OPERATION

Figure 7:
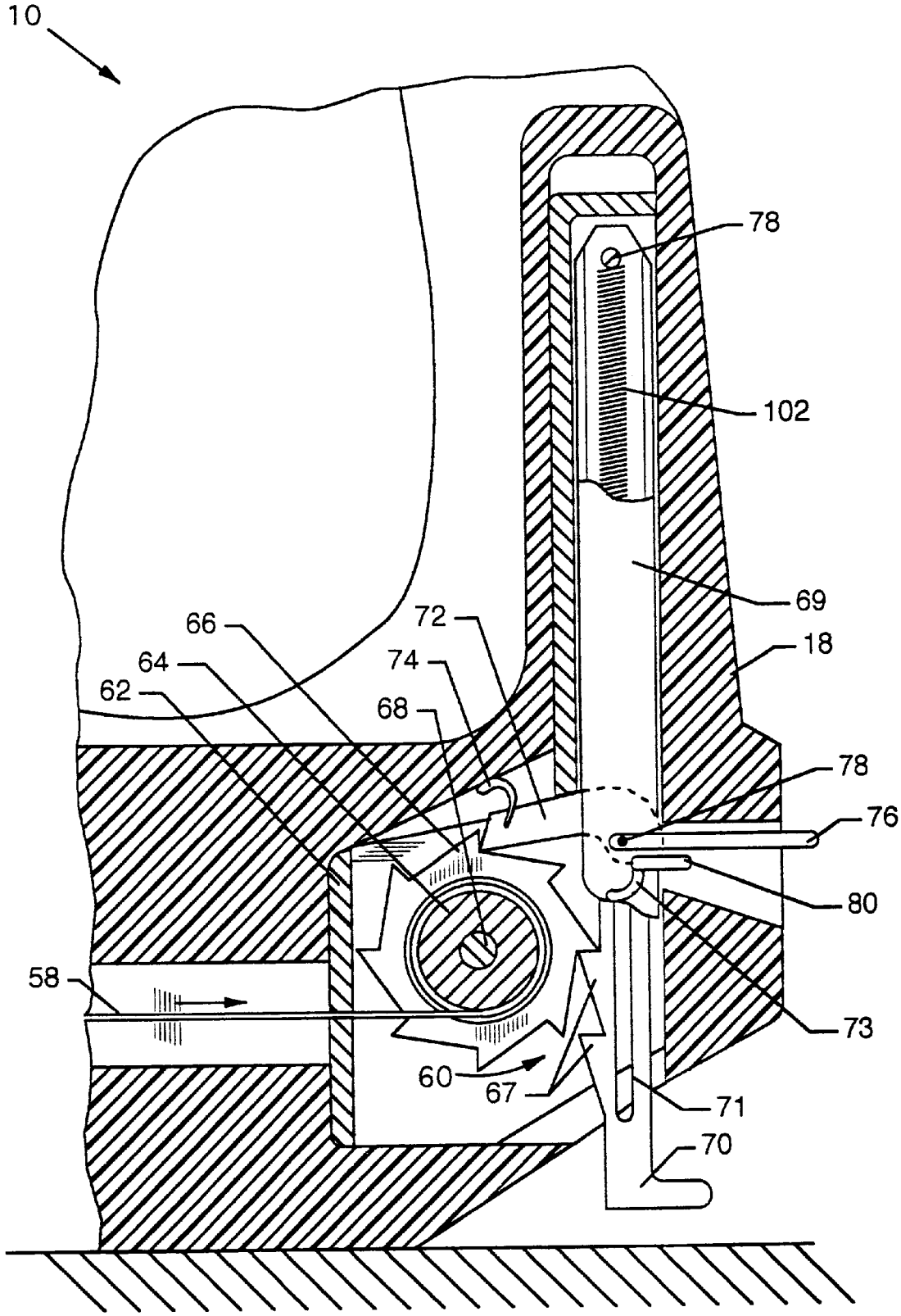
FIG. 7 illustrates a cross sectional view of the posterior portion of the automated tightening and loosening shoe along the line 7—7 of FIG. 2, with the tightening mechanism depicted in the unactivated or neutral position.
Figure 8:
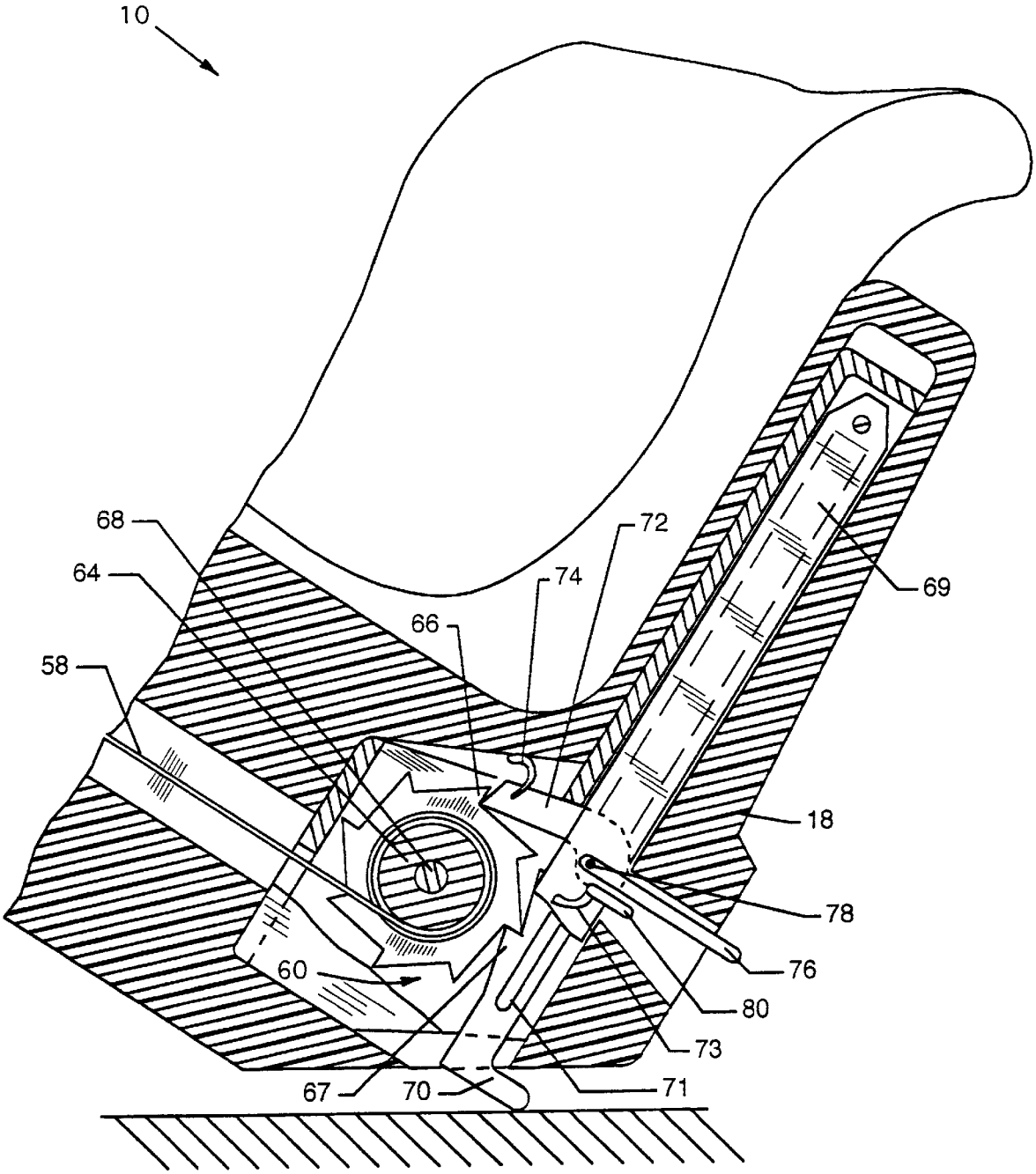
FIG. 8 illustrates a cross sectional view, similar to FIG. 7, of the posterior portion of the automated tightening and loosening shoe, but with the tightening mechanism depicted in the activated position.
Figure 9:
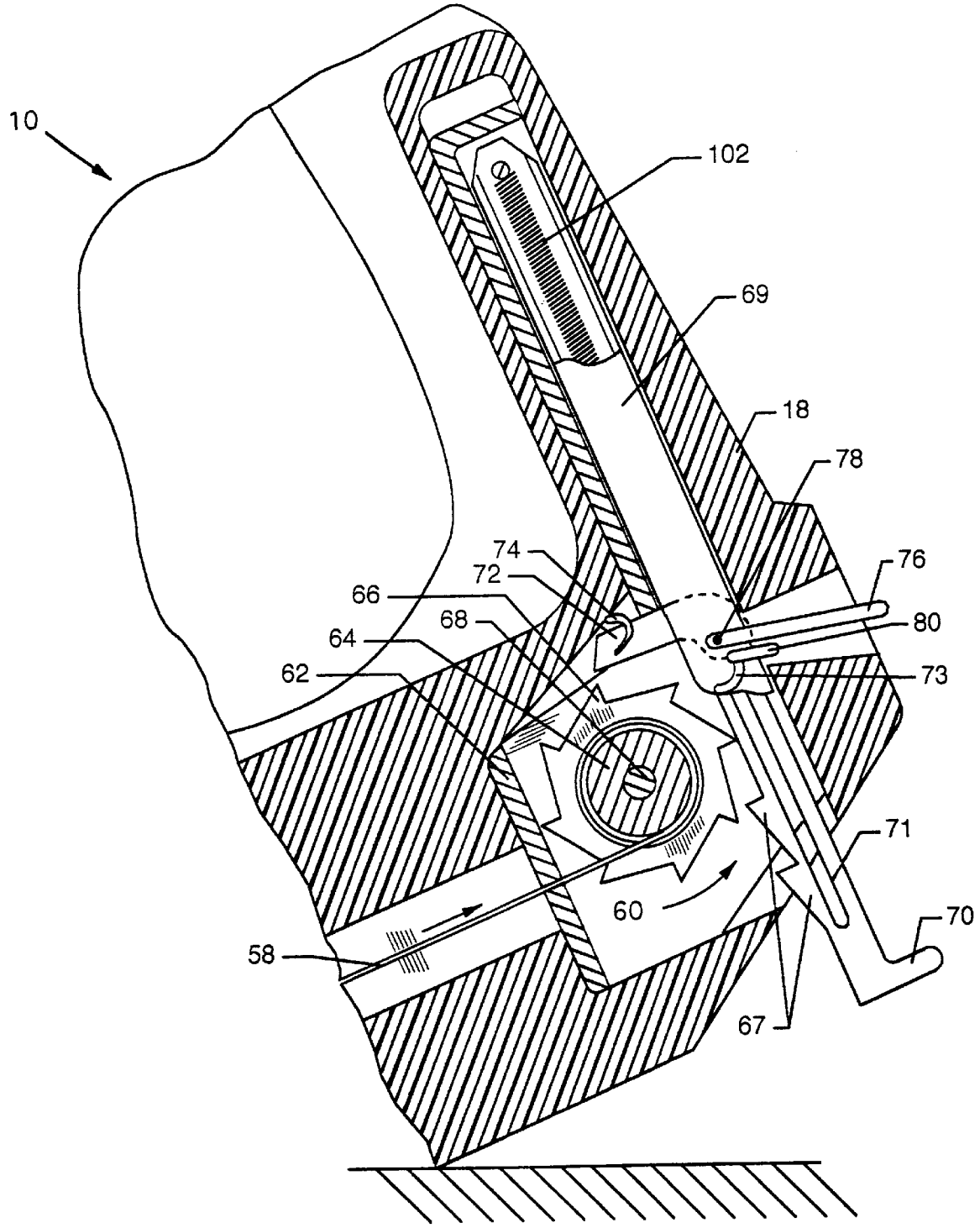
FIG. 9 illustrates a cross sectional view, similar to FIG. 7, of the posterior portion of the automated tightening and loosening shoe, but with the disengage lever depicted in the activated position and the actuating lever depicted in the completely released or disengaged position.

FIG. 7, FIG. 8 and FIG. 9 best illustrate the mode of operation of the shoe 10. Therein all numerals correspond to those elements previously described. FIG. 7 illustrates a cross-sectional view of the posterior portion of the shoe 10 along the line 7—7 of FIG. 2, with the tightening mechanism 60 depicted in the unactivated or neutral position; FIG. 8 is a view similar to that of FIG. 7, but with the tightening mechanism 60 depicted in the activated position; and FIG. 9 is a view similar to that of FIG. 7, but depicting the disengage lever 76 in the activated position and the actuating lever 70 in the completely released or disengaged position.

The mode of operation is now described. The shoe 10 is slipped onto the foot, tilted back on the heel 18, and tapped on the ground, the floor, or other such surface. This action causes the actuating lever 70, which protrudes beyond the external surface of the shoe 10, to be advanced up into the actuating lever encasement 69, compressing the spring 102 and thereby permitting the actuating lever teeth 67 to engage the ratchet teeth 66 and turn the ratchet reel 64 counterclockwise, that is, in the tightening direction. As the ratchet reel 64 turns, the actuating cable 58 winds or spools about the ratchet reel 64, tightens, and exerts a pulling force on the rigid, semi-rigid or flexible polymer bands 34, 36 and 38 to tighten them. The ratchet pawl 72 is pressed down by the pawl spring 74 into the path of the ratchet teeth 66, allowing the ratchet reel 64 to rotate counterclockwise step by step, but not clockwise, and therefore holding the actuating cable 58 in a tightened position until the disengage lever 76 is actuated. When the shoe 10 is tilted back to the upright position, the spring 102 expands back to its normal uncompressed state, thereby driving the actuating lever 70 back to its original position, ready to be tapped again. Elasticity in the heel 18 allows the actuating encasement 69 sufficient movement to the right to provide and allow repositioning of the lever teeth 67 past the ratchet teeth 66 as the actuating lever 70 is forcefully driven downwardly by the spring 102. This action is repeated until adequate tightness is achieved.

When it is desired to release the tightening mechanism 60 to loosen the rigid, semi-rigid or flexible polymer bands, the disengage lever 76 is pressed downwardly to engage the posterior pawl arm 80 and thus cause the ratchet pawl 72 to pivot about the axle 78, thereby disengaging the ratchet reel 64 and allowing it to rotate clockwise and loosen the actuating cable 58. Then the inherent spring memory of the rigid, semi-rigid or flexible polymer bands 34, 36 and 38 combined with the retracting forces of the intermediate springs 48 and 50 and the retracting elastic bands 94 causes advance of the rigid, semi-rigid or flexible polymer bands 34, 36 and 38 to their loosened condition, thus loosening the reinforced lacing pad 14 and opening the shoe 10.

It should be noted that the entire tightening and loosening procedure, even the step of slipping the shoe 10 onto the foot, can be carried out without the use of the hands, if necessary or desired. In this respect, tightening of the shoe 10 by tapping the actuating lever 70 on the ground, the floor or other such surface obviously requires no use of the hands; and loosening of the shoe 10 by manipulation of the disengage lever 76, which protrudes rearwardly from the shoe heel 18, can be accomplished by the toe of the companion shoe or the wearer's opposite foot itself, thus also not requiring use of the hands.

Figure 10A:
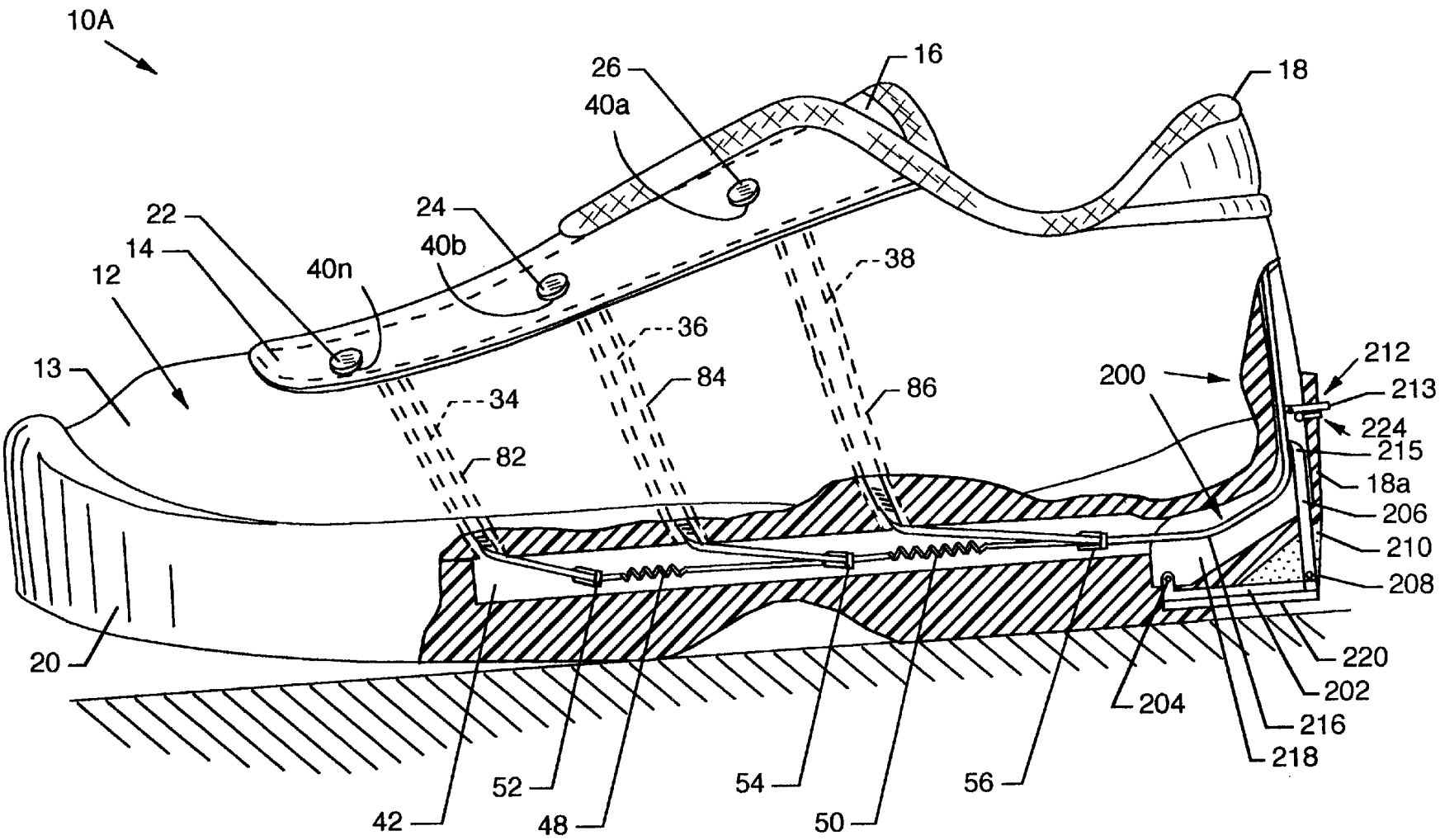
FIG. 10A illustrates a side view of a first alternate embodiment of the automated tightening and loosening shoe with parts in section and portions cut away to reveal internal details.
Figure 10B:
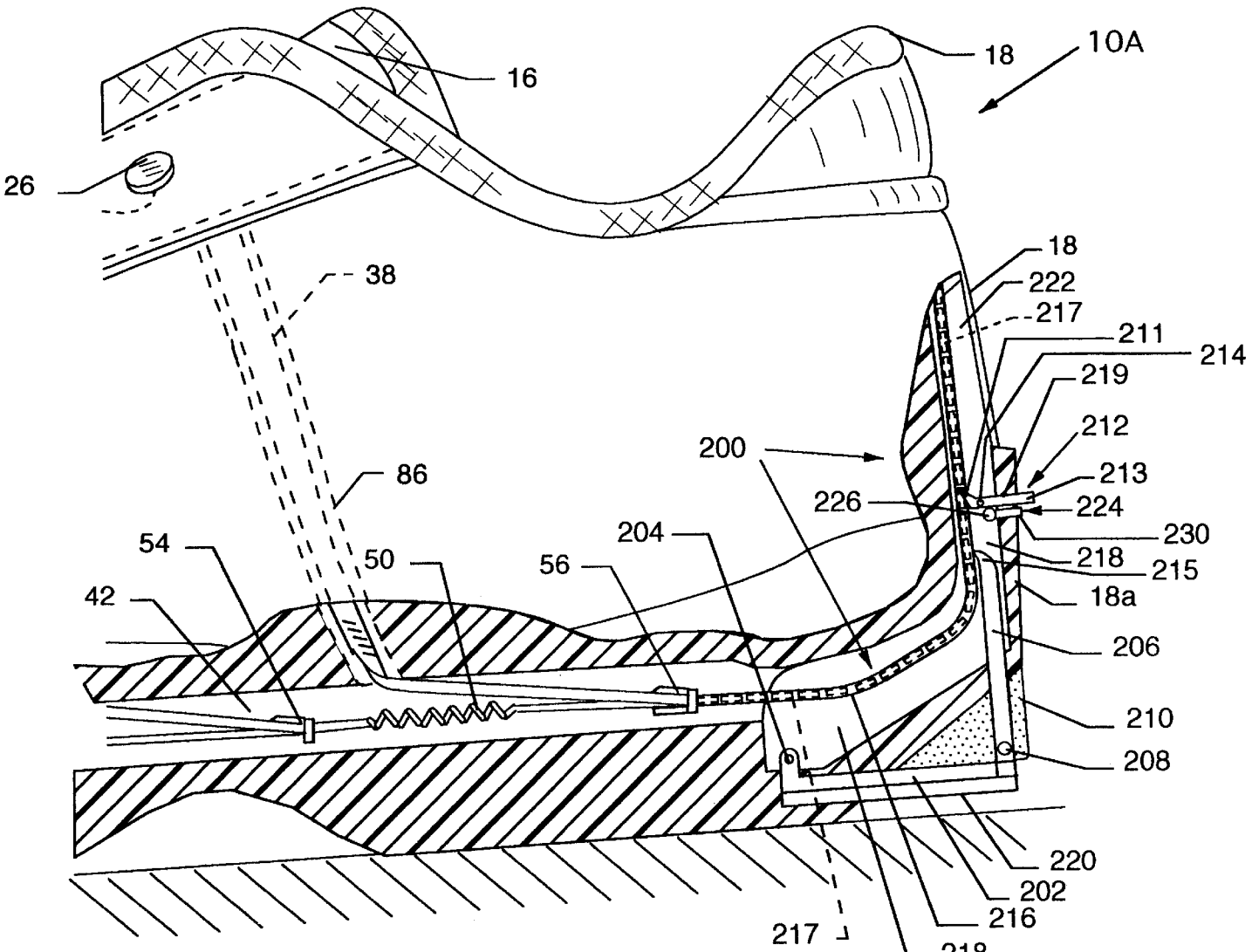
FIG. 10B illustrates a close up view of the heel area of the first alternate embodiment of the automated tightening and loosening shoe with parts in section and with portions cut away to reveal internal details.
Figure 11:
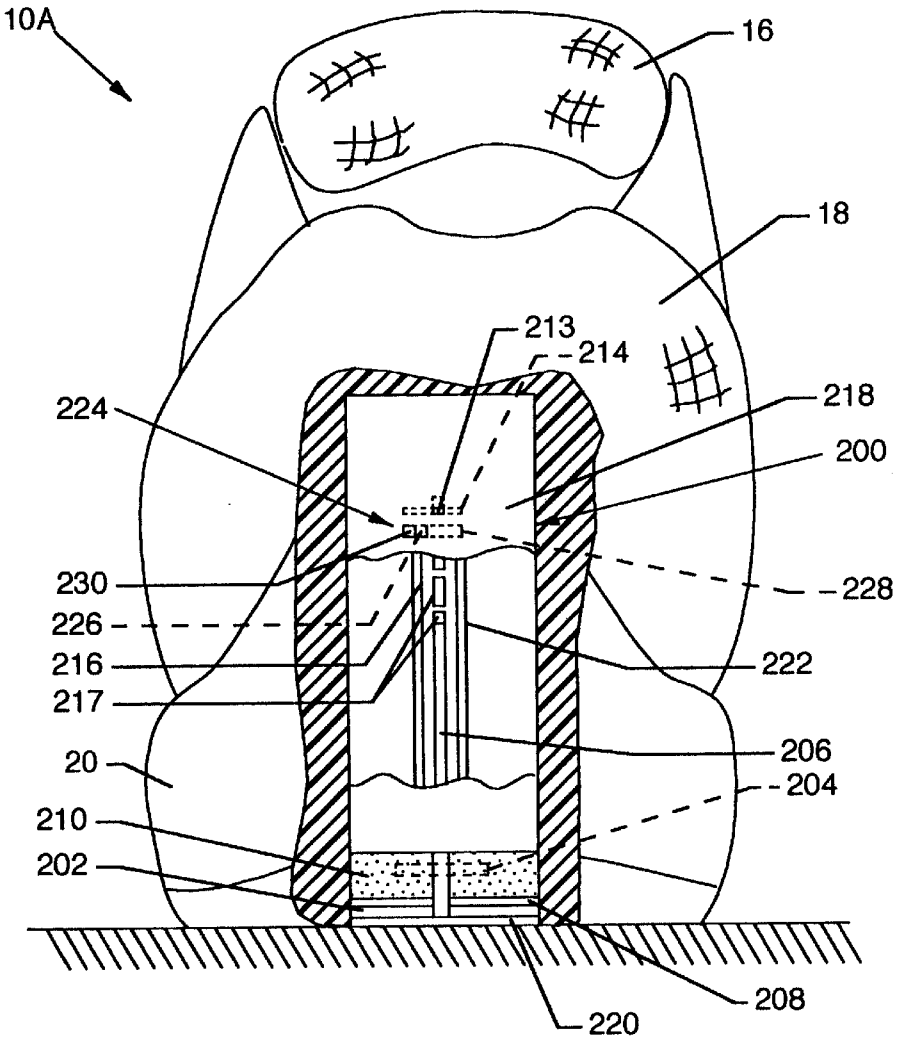
FIG. 11 illustrates a rear view of the first alternate embodiment of the automated tightening and loosening shoe with parts in section and portions cut away to reveal internal details.

FIG. 10A, a first alternative embodiment, illustrates a side view, with parts in section and portions cut away to reveal internal details, FIG. 10B illustrates a close up view of the heel area, and FIG. 11 illustrates a rear view, with parts in section and portions cut away to reveal internal details, of an shoe 10A, where all numerals which have appeared previously correspond to those elements previously described. The automated tightening and loosening shoe 10A of this first alternate embodiment is again depicted as a sport or athletic shoe, but it is to be understood that the principles of the invention are applicable to shoes of any other type and style.

In the shoe 10A, and with reference to FIGS. 10A, 10B and 11, as with the shoe 10 illustrated in FIGS. 1–9, the sole 20 is provided with a chamber 42 which communicates with the lower ends of the stitched slots 82, 84, 86, 88, 90 and 92 which are within the integral body member 12 at the sides of the shoe rearward of the toe 13. The chamber 42 houses the midportions of the rigid, semi-rigid or flexible polymer bands 34, 36 and 38 which cross over each other, or alternatively, are arranged in parallel fashion, above the shoe tongue 16 and attach to the respective pairs of anchor button holes 40*a*–40*a*', 40*b*–40*b*' and 40*n*–40*n*' in the reinforced lacing pad 14 by the anchor buttons 22, 24, 26, 28, 30 and 32 affixed on their tips. Although not illustrated in the views of FIGS. 10A, 10B and 11, the shoe 10A, like the shoe 10, is equipped with retracting elastic bands 94 residing in the stitched slots 86 and 92, and each retracting elastic band 94 is attached at one of its ends to the integral body member 12 adjacent to the reinforced lacing pad 14 by connector pins 96 and 98 and at the other of its ends to the rigid, semi-rigid or flexible polymer band 38 by stitching 100 in identical fashion to that shown in detail in FIG. 4 in conjunction with the correspondingly numbered parts of the shoe 10. Likewise, in the shoe 10A, as with the shoe 10, the midportions of the rigid, semi-rigid or flexible polymer bands 34, 36 and 38 have respective holes 52, 54 and 56 formed therethrough, and the two intermediate springs 48 and 50 are suitably and appropriately attached to the rigid, semi-rigid or flexible polymer bands 34, 36 and 38 at the holes 52, 54 and 56 such that the spring 48 links rigid, semi-rigid or flexible polymer bands 34, 36 and the spring 50 links rigid, semi-rigid or flexible polymer bands 36 and 38. However, rearwardly of the hole 56 in the rigid, semi-rigid or flexible polymer band 38, the construction of the shoe 10A differs from that of the shoe 10. Specifically, the rigid, semi-rigid or flexible polymer band 38 of the shoe 10A, instead of being further connected to an actuating cable as shown at 58 in the shoe 10, is further connected to a ratchet cable 216 which has a plurality of spaced apart apertures 217 provided along its length; and the ratchet cable 216 in turn leads to and is incorporated into a tightening mechanism 200 which differs significantly from the tightening mechanism 60 of the shoe 10. The tightening mechanism 200, described later in detail, is located in the rearward end of the chamber 42 at the shoe heel 18. The rearward end of the chamber 42 opens to the bottom and rear of the shoe 10A to provide for protruding elements of the tightening mechanism 200 which extend beyond the external surface of the shoe 10A: in particular, a push plate 202, an actuating lever 206, a handle 213 of a pawl 212 and, optionally, an actuating rod 230 of a slidable safety latch 224.

The tightening mechanism 200 is composed of the previously mentioned ratchet cable 216, push plate 202, actuating lever 206, pawl 212 and optionally used slidable safety latch 224, and also includes a compressible and expansible filler material 210, a mechanism encasement 218, and a rubber cover plate 220. The push plate 202 has two ends, one end being pivotable about an axle or pivot pin 204 located within the interior of the chamber 42 at the rear thereof, and the other end being pivotally connected to one end of the actuating lever 206 about an axle or pivot pin 208 located externally of the chamber 42. The other end of the actuating lever 206 extends upwardly into a channel 222 formed in the mechanism encasement 218 and terminates in a nose portion 215 which comes into engagement with the apertures 217 of the ratchet cable 216, which also extends into the channel 222 in the mechanism encasement 218, to advance the ratchet cable 216 in the tightening direction. The plurality of spaced apart apertures 217 provided along the length of the ratchet cable 216 are best seen i FIG. 11. The pawl 212 pivots between an engage position and a disengage position about an axle or pivot pin 214 which extends across the channel 222 in the mechanism encasement 218 and includes a nose portion 211 which enters into the apertures 217 of the ratchet cable 216 in the engage position and a handle 213 for moving the pawl 212 from the engage position to the disengage position. The handle 213 of the pawl 212 extends through and is frictionally engaged within an orifice 219 in the heel portion 18*a* and is biased to the engage position by the urging of the rubber material in the heel portion 18*a*. The compressible and expansible filler material 210 bears against the upwardly facing surface of the push plate 202, surrounds the connection between the push plate 202 and the actuating lever 206 at the axle or pivot pin 208, bears against the external surface of the sole 20, and closes the opening of the chamber 42 at the bottom and rear of the shoe 10A. The rubber cover plate 220 covers the undersurface of the push plate 202. Optionally, the slidable safety latch 224 is provided to prevent inadvertent release of the pawl 212, such as by the upward or otherwise directed action of the pawl handle 213 by foot action of a closely spaced athlete, and is located beneath the pawl handle 213. The slidable safety latch 224 includes a sliding rod 226 which can be horizontally positioned along a channel 228 bridging the channel 222. The actuating rod 230 attaches to and operates the sliding rod 226 and extends through a slot in the heel portion 18*a* just below the orifice 219 through which the pawl handle 213 extends. The sliding rod 226, as viewed in FIG. 11, is positioned by the actuating rod 230 for non-interference with the pawl handle 213, but can be positioned to the right to interfere with and prevent downward movement of the pawl handle 213, thus preventing inadvertent movement of the pawl handle 213.

Figure 12:
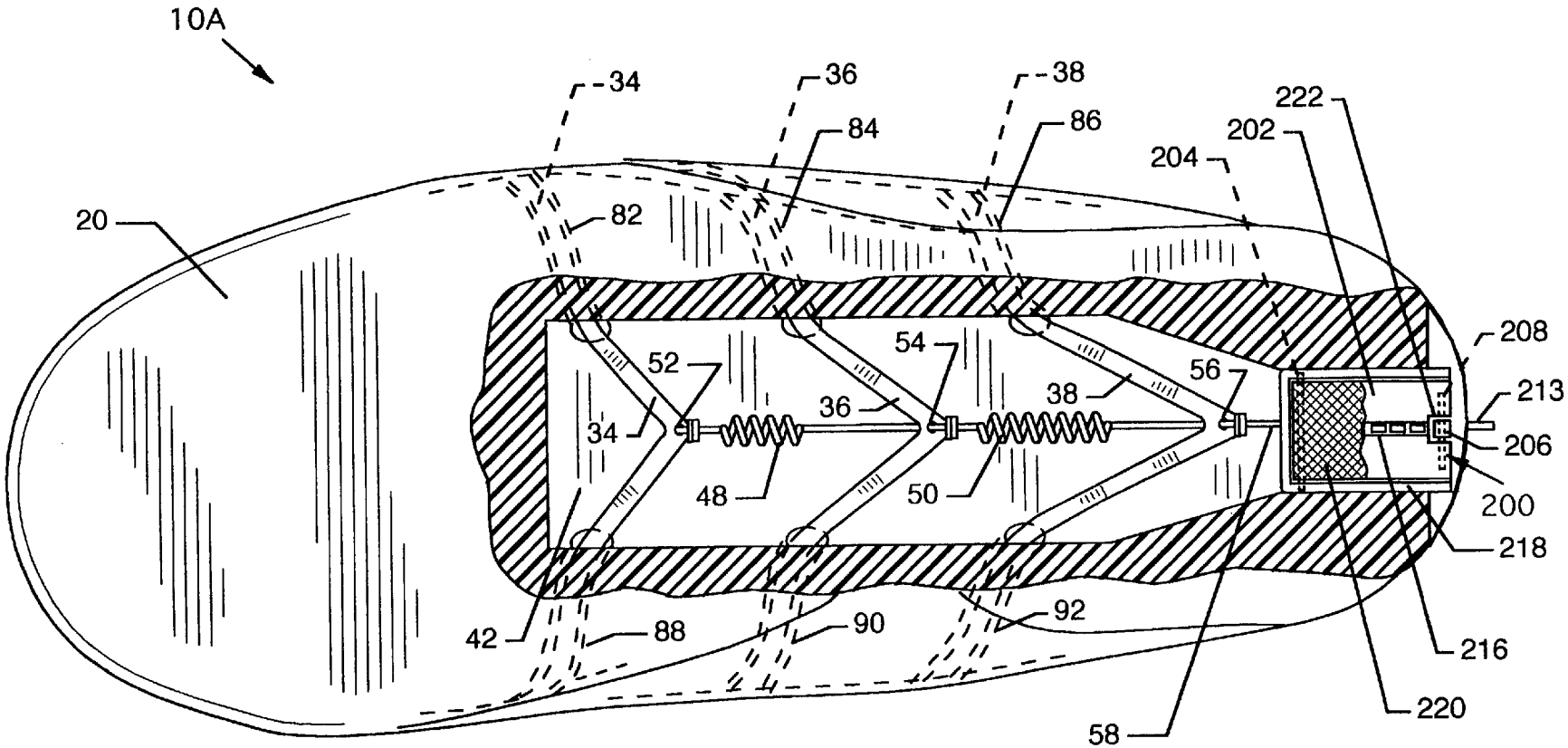
FIG. 12 illustrates a bottom view of the first alternate embodiment of the automated tightening and loosening shoe with parts in section and portions cut away to show internal features.

FIG. 12 illustrates a bottom view of the shoe 10A with parts in section and portions cut away to show internal features, where all numerals which have appeared previously correspond to those elements previously described. This view depicts the full width of the chamber 42 in the sole 20 and more clearly portrays the appearance of the midportions of the rigid, semi-rigid or flexible polymer bands 34, 36 and 38 when in their tightened condition. The intermediate springs 48 and 50 play an essential role in the tightening process, since without them, the shoe could not be tightened properly. In order to tighten the shoe 10A snugly and securely about the wearer's foot, it is necessary that the tension administered to the rigid, semi-rigid or flexible polymer bands 34 and 36 be properly distributed. This is accomplished by employing for the spring 48 a spring which is shorter and more resilient than the spring 50.

MODE OF OPERATION

FIGS. 10A, 10B, 11 and 12

The mode of operation of the shoe 10A constituting the first alternate embodiment of the present invention is now described. The shoe 10A is slipped onto the foot and tilted back on the heel 18. The rubber cover plate 220, which protrudes beyond the external surface of the shoe 10A and which covers the undersurface of the push plate 202, is then tapped on the ground, the floor, or other such surface. This action causes a force to be exerted against the rubber cover plate 220, and, of course, also against the push plate 202 covered therewith, which force is imparted to the filler material 210 and causes compression thereof. The force is also imparted to the actuating lever 206 supported by the push plate 202, thereby causing the actuating lever 206 to move upwards within the channel 222 in the mechanism encasement 218 such that the nose portion 215 of the actuating lever 206 enters into one of the apertures 217 of the ratchet cable 216 within the mechanism encasement 218 and thereby pushes the ratchet cable 216 rearward and upward, that is, in the tightening direction. As the ratchet cable 216 moves in the tightening direction, it exerts a pulling force on the rigid, semi-rigid or flexible polymer bands 34, 36 and 38 to tighten them. Further, as the ratchet cable 216 moves in the tightening direction, heel portion 18*a* constantly biases the pawl 212 to the engage position such that the nose portion 211 of the pawl will successively enter into the plurality of apertures 217 spaced along the ratchet cable 216, thus allowing the ratchet cable 216 to advance rearward and upward, that is, in the tightening direction, step by step, but precluding the ratchet cable 216 from moving downward and forward, that is, in the reverse or loosening direction. When the automated tightening shoe 10A is tilted back to the upright position, that is, when it is moved out of contact with the ground, the floor, or other such surface, the filler material 210 expands back to its normal uncompressed state, thereby driving the push plate 202 and actuating lever 206 back to their original positions, ready to be tapped again. This action is repeated until adequate tightness of the rigid, semi-rigid or flexible polymer bands 34, 36 and 38 is achieved. If the shoe 10A has been equipped with the optional slidable safety latch 224, then when the desired tightness is achieved, the sliding rod 226 of the slidable safety latch 224 is moved into position by use of the actuating rod 230 to block movement of the pawl handle 213.

When it is desired to release the tightening mechanism 200 to loosen the rigid, semi-rigid or flexible polymer bands 34, 36 and 38, the slidable safety latch 224, if present and used, is disengaged, and then the handle 213 of the pawl 212 is pressed downwardly to overcome the biasing force of the heel portion 18*a*, thus causing the pawl 212 to pivot about the axle or pivot pin 214 to the disengage position wherein the nose portion 211 of the pawl 212 is released from engagement in any of the apertures 217 of the ratchet cable 216 so that the ratchet cable 216 is free to move downward and forward, that is, in the loosening direction, under the influence of the inherent spring memory of the rigid, semi-rigid or flexible polymer bands 34, 36 and 38 combined with the retracting forces of the intermediate springs 48 and 50 and the retracting elastic bands 94 (as seen in FIG. 4). When the tightening mechanism 200 is so released, the rigid, semi-rigid or flexible polymer bands 34, 36 and 38 are returned to their original loosened condition, thus also loosening the reinforced lacing pad 14 and enabling the shoe 10A to be removed from the foot.

As with the shoe 10, the entire tightening and loosening procedure just described for the shoe 10A can be accomplished, if necessary or desired, without the use of the hands inasmuch as tapping of the shoe 10A to tighten it does not involve use of the hands, and pressing of the handle 213 of the pawl 212 to loosen the shoe can be effected by the toe of the companion shoe or the wearer's opposite foot.

Figure 13:
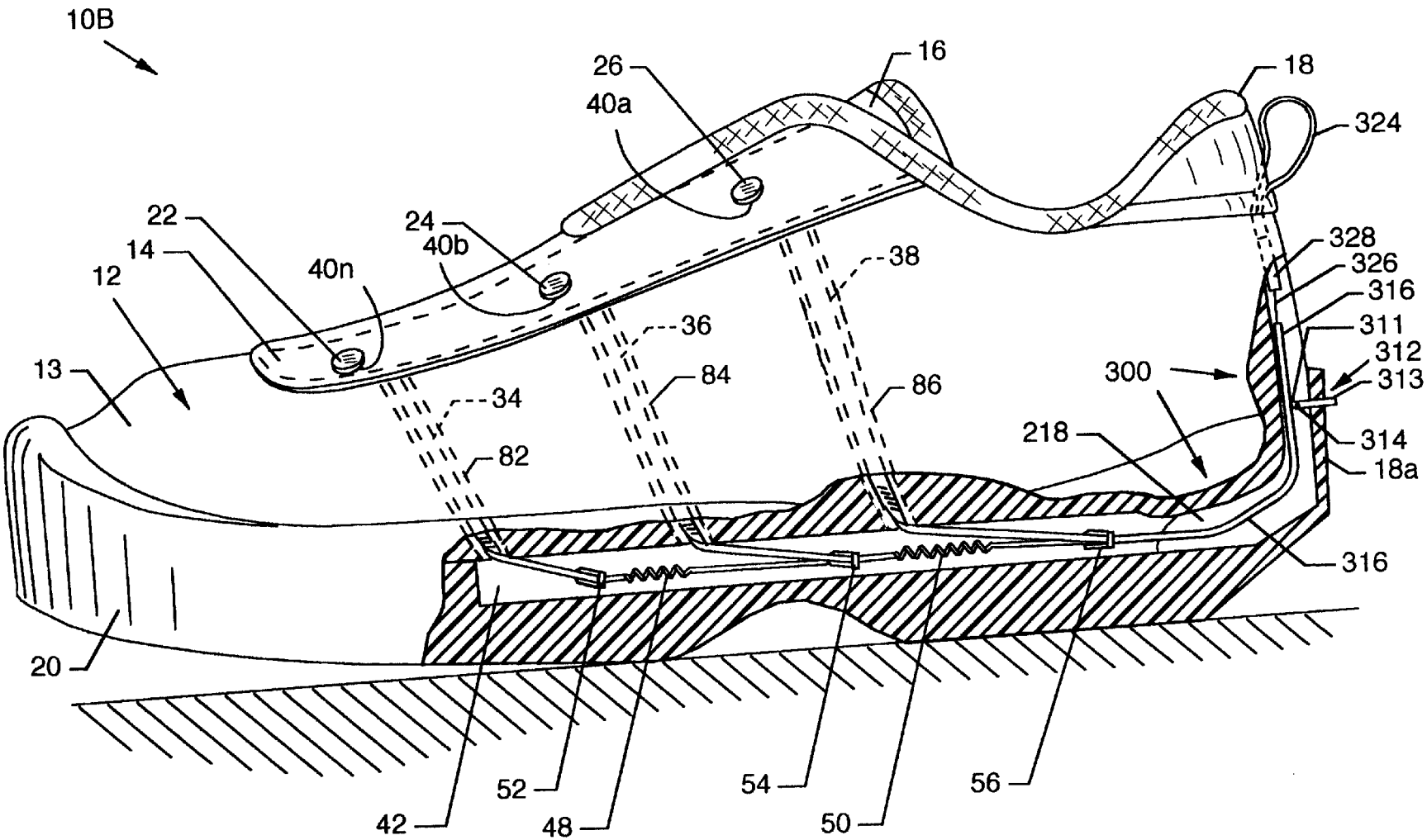
FIG. 13 illustrates a side view of a second alternate embodiment of the automated tightening and loosening shoe with parts in section and portions cut away to reveal internal details.

FIG. 13, a second alternative embodiment, illustrates a side view, with parts in section and portions cut away to reveal internal details, of an automated tightening and loosening shoe 10B, where all numerals which have appeared previously correspond to those elements previously described. Except for the shoe heel and the tightening mechanism employed for tightening the rigid, semi-rigid or flexible polymer bands 34, 36 and 38, the shoe 10B is identical to the shoe 10A shown in FIGS. 10A, 10B, 11 and 12. Accordingly, to avoid needless repetition in the description, only those elements of the shoe 10B which differ from the construction of the shoe 10A are described in particular.

The tightening mechanism employed in the shoe 10B is designated in its entirety by the reference numeral 300 and, as with the tightening mechanism 200 of the shoe 10A, is located in the rearward end of the chamber 42 at the shoe heel 18. The heel 18 has small openings at about the midportion and at the top thereof to provide for two protruding elements of the tightening mechanism 300 which extend beyond the external surface of the shoe 10B: in particular, a handle 313 of a pawl 312, and a pull tab or loop 324.

Figure 16:
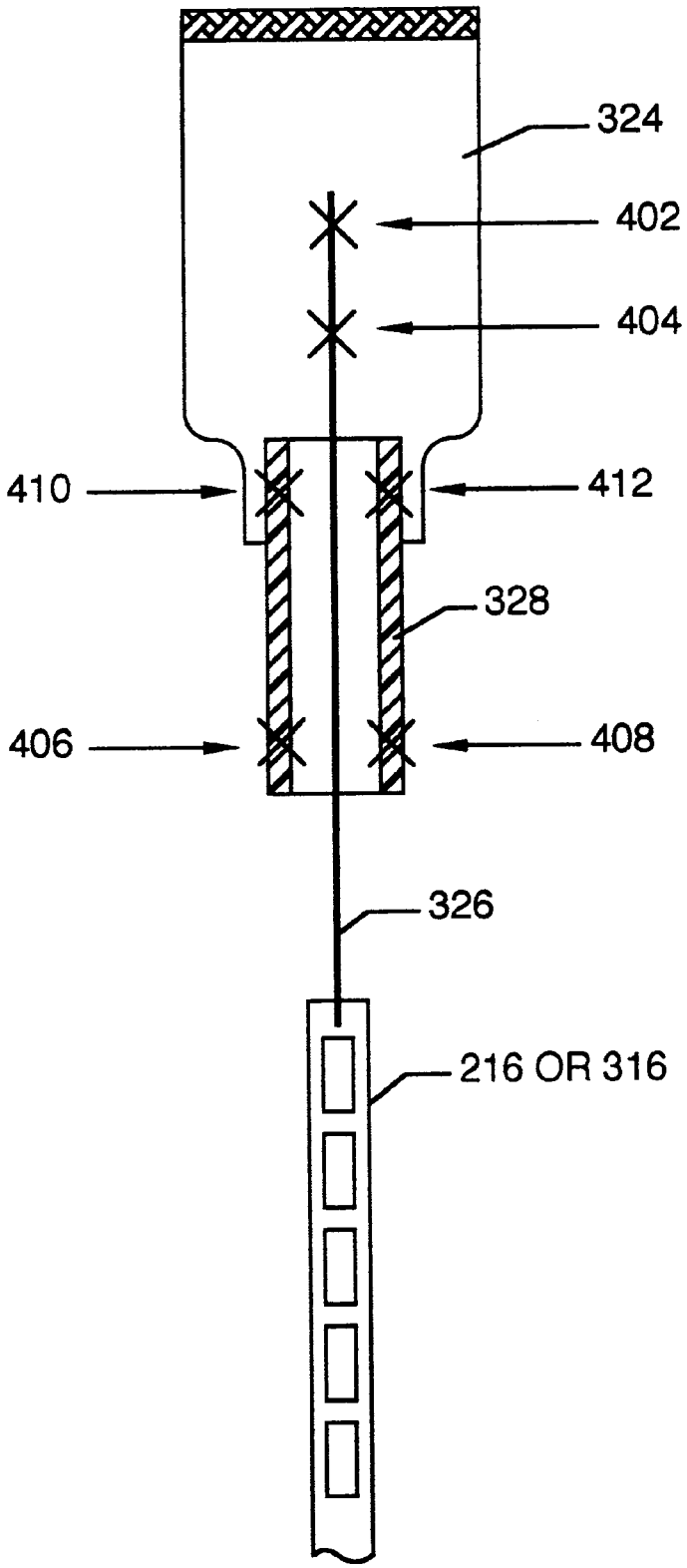

Similarly to the tightening mechanism 200 of the shoe 10A, the tightening mechanism 300 of the shoe 10B comprises a ratchet cable 316 having one end attached at the hole 56 in the rigid, semi-rigid or flexible polymer band 38. From its point of attachment at the hole 56, the ratchet cable 316 extends rearward and upward in the chamber 42. The other or upward end of the ratchet cable 316 is attached to an intermediate cord 326 or other suitable member which in turn is attached to the pull tab or loop 324. A stretchable elastic tube 328 houses the greater portion of the cord 326 and is suitably anchored, as illustrated in FIG. 16, to retract and store a major portion of the cord 326 when upward pressure on the loop 324 is relaxed. A plurality of spaced apart apertures, like the apertures 217 in the ratchet cable 216 of the shoe 10A, are provided along the length of the ratchet cable 316; and these apertures are successively engageable by a nose portion 311 of a pawl 312 which is mounted to the heel portion 18*a* by an axle or pivot pin 314 about which the pawl 312 pivots between an engage position and a disengage position. A handle 313 of the pawl 312 extends through and is frictionally engaged within an orifice in the heel portion 18*a* and is biased to the engage position by the urging of the rubber material in the heel portion 18*a*. The handle 313 is provided on the pawl 312 for moving the pawl 312 from the engage position to the disengage position. Optionally, slidable safety latch 224, as previously described, can be incorporated into the shoe 10B.

MODE OF OPERATION

FIG. 13

Referring still to FIG. 13, the mode of operation of the shoe 10B constituting the second alternate embodiment of the present invention is now described.

The shoe 10B is slipped onto the foot. The pull tab or loop 324 is connected to the upward end of the ratchet cable 316 by the intermediate cord 326 or other suitable member which is pulled upward to achieve rearward and upward movement of the ratchet cable 316. As the ratchet cable 316 advances rearward and upward, it tightens and exerts a pulling force on the rigid, semi-rigid or flexible polymer bands 34, 36 and 38 to tighten them. The pawl 312 is urged downwardly by the heel portion 18*a* into the path of the spaced apart apertures in the ratchet cable 316 such that the nose portion 311 of the pawl 312 successively enters into the plurality of apertures, thereby allowing the ratchet cable 316 to advance rearward and upward, that is, in the tightening direction, step by step, but not downward and forward, that is, in the reverse or loosening direction. When the pull tab or loop 324 is released, the retracting elastic tube 328 contracts and the cord 326 is repositioned internally within the elastic tube 328. The recoiling force produced by such contraction returns the pull tab or loop 324 to its original position, ready to be pulled again. This action is repeated until adequate tightness of the rigid, semi-rigid or flexible polymer bands 34, 36 and 38 is achieved.

When it is desired to release the tightening mechanism 300 to loosen the rigid, semi-rigid or flexible polymer bands 34, 36 and 38, the handle 313 of the pawl 312 is pressed downwardly to overcome the biasing force of the heel portion 18*a*, thus causing the pawl 312 to pivot about the axle or pivot pin 314 to the disengage position wherein the nose portion 311 of the pawl 312 is released from engagement in any of the apertures of the ratchet cable 316 so that the ratchet cable 316 is free to move downward and forward, that is, in the loosening direction, under the influence of the inherent spring memory of the rigid, semi-rigid or flexible polymer bands 34, 36 and 38 combined with the retracting forces of the intermediate springs 48 and 50 and the retracting elastic bands 94 (as seen in FIG. 4). When the tightening mechanism 300 is so released, the rigid, semi-rigid or flexible polymer bands 34, 36 and 38 are returned to their original loosened condition, thus also loosening the reinforced lacing pad 14 and enabling the shoe 10B to be removed from the foot.

The tightening procedure involved with the shoe 10B does require the use of a hand, but, as with the shoes 10 and 10A, loosening can be accomplished without the use of hands simply by pressing the handle 313 of the pawl 312 downwardly with the toe of the companion shoe or with the opposite foot itself.

Figure 14:
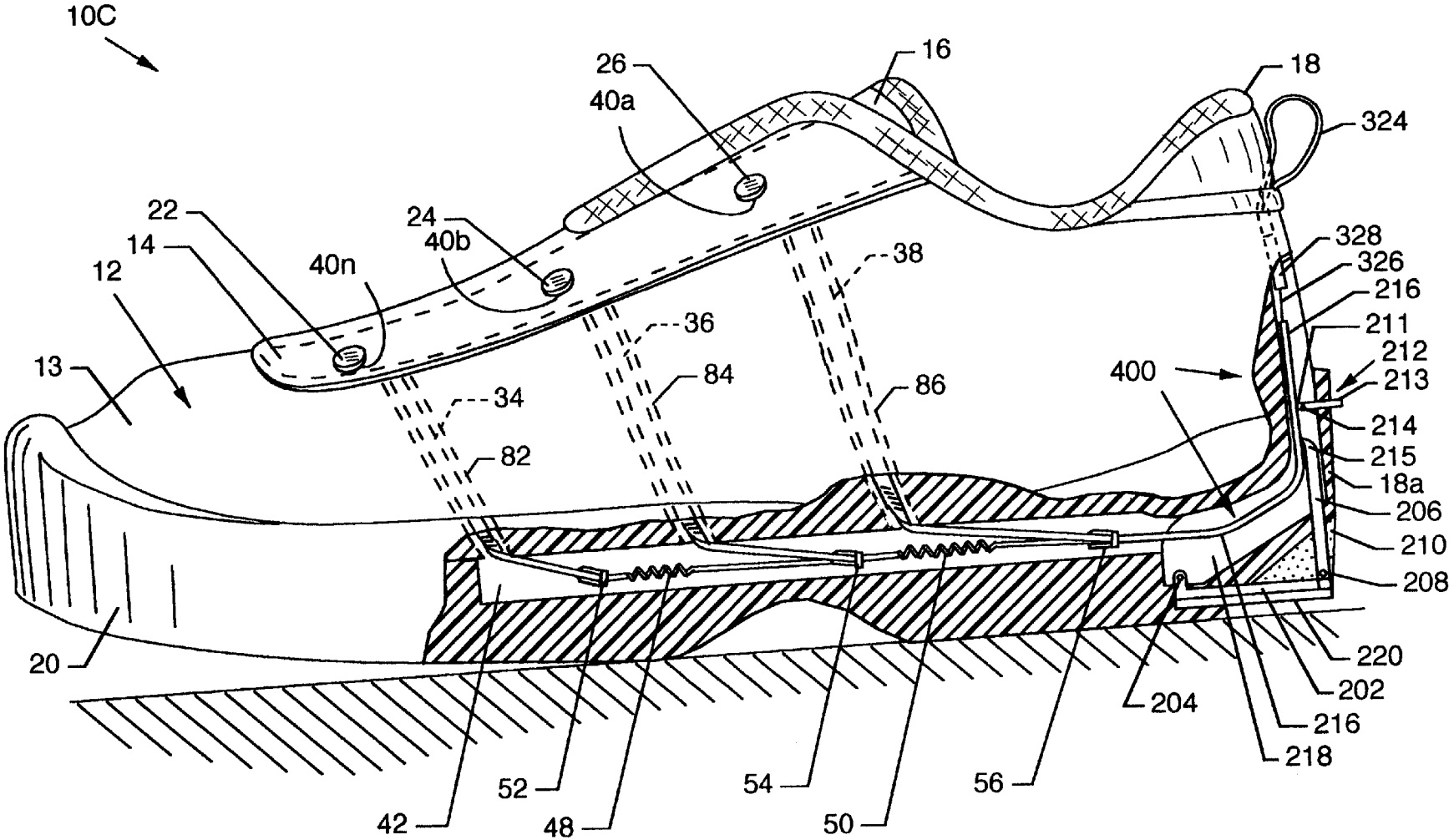
FIG. 14 illustrates a side view of a third alternate embodiment of the automated tightening and loosening shoe with parts in section and portions cut away to reveal internal details.
Figure 15:
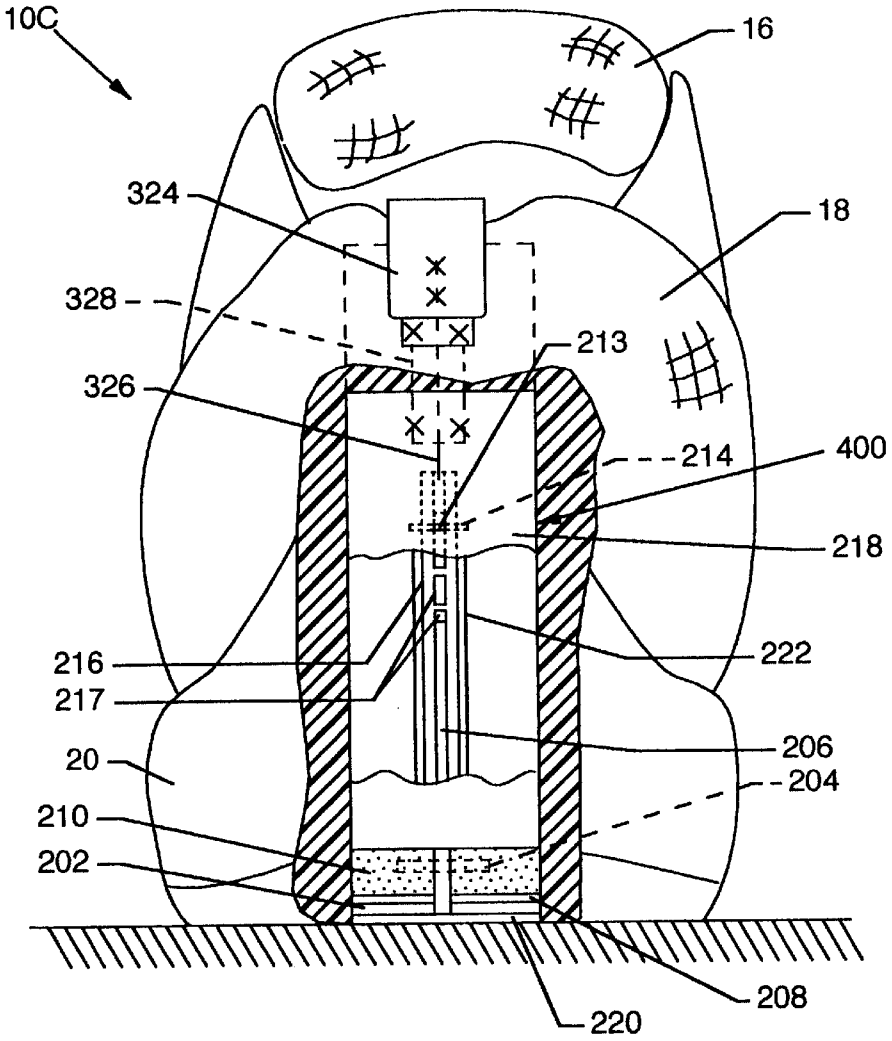
FIG. 15 illustrates a rear view of the third alternate embodiment of the automated tightening and loosening shoe with parts in section and portions cut away to reveal internal details; and, FIG. 16 illustrates the relationship of the pull tab or loop to the elastic tube, the cord and to various ratchet cables as used in the second and third alternate embodiments of the invention.

FIG. 14, a third alternative embodiment, illustrates a side view, with parts in section and portions cut away to reveal internal details, and FIG. 15 illustrates a rear view, with parts in section and portions cut away to reveal internal details, of an automated tightening and loosening shoe 10C, where all numerals which have appeared previously correspond to those elements previously described.

The shoe 10C employs a tightening mechanism 400 which is a composite of the tightening mechanisms 200 and 300 of the shoes 10A and 10B, respectively. To facilitate comparison of the tightening mechanism 400 with the tightening mechanisms 200 and 300 previously described, those individual elements of the tightening mechanism 400 which are common to the tightening mechanism 200 are identified with the same reference numerals utilized to identify the individual elements of the tightening mechanism 200, and those individual elements of the tightening mechanism 400 which are common to the tightening mechanism 300 are identified with the same reference numerals utilized to identify the individual elements of the tightening mechanism 300. All of the various individual elements of the tightening mechanism 400 of this third alternate embodiment shoe 10C have been fully described and explained in relation to the shoes 10A and 10B of the first and second alternate embodiments. Accordingly, further description and explanation of those individual elements is not needed, it being only necessary to describe and explain the various manners in which the tightening mechanism 400 can be operated to achieve tightening of the shoe 10C, and this is done below. First, however, it is pointed out that as an option a slidable safety latch 224, as previously described, can be incorporated into the shoe 10C.

MODE OF OPERATION

FIGS. 14 AND 15

The tightening mechanism 400 of the shoe 10C has, in effect, three different modes by which it can be operated to tighten the rigid, semi-rigid or flexible polymer bands 34, 36 and 38, each of which modes of tightening is now described.

As a first mode of tightening, the shoe 10C is slipped onto the foot and tilted back on the heel 18. The rubber cover plate 220, which protrudes beyond the external surface of the shoe 10C and which covers the undersurface of the push plate 202, is then tapped on the ground, the floor, or other such surface. This action causes a force to be exerted against the rubber cover plate 220, and, of course, also against the push plate 202 covered therewith, which force is imparted to the filler material 210 and causes compression thereof. The force is also imparted to the actuating lever 206 supported by the push plate 202, thereby causing the actuating lever 206 to move upwards within the channel 222 in the mechanism encasement 218 such that the actuating nose portion 215 of the lever 206 enters into one of the apertures 217 of the ratchet cable 216 within the mechanism encasement 218 and thereby pushes the ratchet cable 216 rearward and upward, that is, in the tightening direction. As the ratchet cable 216 moves in the tightening direction, it exerts a pulling force on the rigid, semi-rigid or flexible polymer bands 34, 36 and 38 to tighten them. Further, as the ratchet cable 216 moves in the tightening direction, the heel portion 18*a* constantly biases the pawl 212 to the engage position such that the nose portion 211 of the pawl will successively enter into the plurality of apertures 217 spaced along the ratchet cable 216, thus allowing the ratchet cable 216 to advance rearward and upward, that is, in the tightening direction, step by step, but precluding the ratchet cable 216 from moving downward and forward, that is, in the reverse or loosening direction. When the automated tightening shoe 10C is tilted back to the upright position, that is, when it is moved out of contact with the ground, the floor, or other such surface, the filler material 210 expands back to its normal uncompressed state, thereby driving the push plate 202 and actuating lever 206 back to their original positions, ready to be tapped again. This action is repeated until adequate tightness of the rigid, semi-rigid or flexible polymer bands 34, 36 and 38 is achieved.

As a second mode of tightening, the shoe 10C is slipped onto the foot. The pull tab or loop 324 connected to the upward end of the ratchet cable 216 by the cord 326 is pulled upward to achieve rearward and upward movement of the ratchet cable 216. As the ratchet cable 216 advances rearward and upward, it tightens and exerts a pulling force on the rigid, semi-rigid or flexible polymer bands 34, 36 and 38 to tighten them. The pawl 212 is urged downwardly by the heel portion 18*a* into the path of the spaced apart apertures 217 in the ratchet cable 216 such that the nose portion 211 of the pawl 212 successively enters into the plurality of apertures 217, thereby allowing the ratchet cable 216 to advance rearward and upward, that is, in the tightening direction, step by step, but not downward and forward, that is, in the reverse or loosening direction. When the pull tab or loop 324 is released, the cord 326 is retracted by and into the interior of the elastic tube 328. The recoiling force produced by such contraction of the elastic tube 328 returns the pull tab or loop 324 to its original position, ready to be pulled again. This action is repeated until adequate tightness of the rigid, semi-rigid or flexible polymer bands 34, 36 and 38 is achieved.

As a third mode of tightening, the tightening procedures of the first and second modes just described can be combined. More specifically, tightening of the rigid, semi-rigid or flexible polymer bands 34, 36 and 38 can be accomplished by combining tapping of the heel 18 on the ground, the floor, or other such surface with pulling of the pull tab or loop 324.

When it is desired to release the tightening mechanism 400 from its tightened condition as attained by following any one of the three tightening modes described, the handle 213 of the pawl 212 is pressed downwardly to overcome the biasing force of the heel portion 18*a*, thus causing the pawl 212 to pivot about the axle or pivot pin 214 to the disengage position wherein the nose portion 211 of the pawl 212 is released from engagement in any of the apertures 217 of the ratchet cable 216 so that the ratchet cable 216 is free to move downward and forward, that is, in the loosening direction, under the influence of the inherent spring memory of the rigid, semi-rigid or flexible polymer bands 34, 36 and 38 combined with the retracting forces of the intermediate springs 48 and 50 and the retracting elastic bands 94 (as seen in FIG. 4). When the tightening mechanism 400 is so released, the rigid, semi-rigid or flexible polymer bands 34, 36 and 38 are returned to their original loosened condition, thus also loosening the reinforced lacing pad 14 and enabling the shoe 10C to be removed from the foot.

FIG. 16 illustrates the arrangement and relationship of the pull tab or loop 324 to the elastic tube 328 and to the ratchet cables 216 or 316, previously described, and to the cord 326, where all numerals correspond to those elements previously or other otherwise described. The cord 326 is suitably secured to the top end of the ratchet cables 216 or 316 and extends through the open tubular center of the elastic tube 328 and is secured to the pull tab or loop 324, such as shown by securing points 402 and 404. The lower end of the elastic tube 328 is secured, such as shown by securing points 406 and 408, for purposes of example and illustration, to the outer or inner covering of the automated tightening and loosening shoe. The upper end of the elastic tube 328 is secured, such as shown by securing points 410 and 412, for purposes of example and illustration, to the lower portion of the pull tab or loop 324. As the loop or pull tab 324 is urged upwardly, the cord 326 moves the ratchet cables 216 or 316 upwardly, as previously described. During this upward movement of the cord 326, the elastic tube 328 is stretched upwardly. Subsequent to desired positioning of the ratchet cables 216 or 316, the loop or pull tab 324 is relaxed, thereby causing the pull tab or loop 324 to be repositioned downwardly to its static position by action of the anchored elastic tube 328. The interior of the elastic tube 328 is of sufficient volume to loosely accommodate and store the excess portion of the relaxed cord 326. Location of the pull tab or loop 324 and associated components can be placed at areas other than shown and shall not be deemed to be limiting to the scope of the invention.

Various modifications can be made to the present invention without departing from the apparent scope hereof.

It is claimed:

1. An automated tightening and loosening shoe comprising:

a. a shoe with a sole, a heel, a toe an upper connected to the sole and having, a lacing pad and a tongue fixed thereto;

b. a plurality of polymer bands, each having inherent spring memory, crossing said tongue and connected to said lacing pad; and, c. a tightening mechanism located at said heel, said tightening mechanism including a cable which is connected to said plurality of polymer bands and which is advanceable in a tightening direction toward said heel, and said tightening mechanism also including means for advancing said cable in said tightening direction to thereby tighten said plurality of polymer bands about said tongue and thus tighten said shoe.

2. The automated tightening and loosening shoe as defined in claim 1, wherein said means for advancing said cable in said tightening direction includes a ratchet reel for spooling said cable thereabout to advance said cable in said tightening direction.

3. The automated tightening and loosening shoe as defined in claim 2, wherein said ratchet reel includes a plurality of ratchet teeth, and wherein said tightening mechanism further includes a pawl for co-acting with said ratchet teeth to obstruct reverse movement of said ratchet reel when said cable is being spooled about said ratchet reel.

4. The automated tightening and loosening shoe as defined in claim 3, wherein said tightening mechanism further includes a disengage lever connected to said pawl and protruding outwardly of said heel for releasing said pawl from contact with said ratchet teeth to thereby allow reverse movement of said ratchet reel.

5. The automated tightening and loosening shoe as defined in claim 3, wherein said means for advancing said cable in said tightening direction further includes an actuating lever having a first portion within said heel and a second portion extending outwardly of said heel, said actuating lever having a plurality of teeth for engaging said plurality of ratchet teeth to rotate said ratchet reel to spool said cable thereabout.

6. The automated tightening and loosening shoe as defined in claim 1, wherein said means for advancing said cable in said tightening direction includes an actuating lever for pushing said cable to advance said cable in said tightening direction.

7. The automated tightening and loosening shoe as defined in claim 6, wherein said cable is a ratchet cable having a plurality of spaced apart apertures along its length, and wherein said actuating lever includes a nose portion for entering into said apertures successively to push said ratchet cable in said tightening direction.

8. The automated tightening and loosening shoe as defined in claim 7, wherein said tightening mechanism further includes a pawl having a nose portion for entering into said apertures successively to obstruct reverse movement of said ratchet cable as it is pushed in said tightening direction by said actuating lever.

9. The automated tightening and loosening shoe as defined in claim 8, wherein said pawl further has a handle protruding outwardly of said heel for releasing said pawl from an aperture in said ratchet cable to thereby allow reverse movement of said ratchet cable.

10. The automated tightening and loosening shoe as defined in claim 6, wherein said means for advancing said cable in said tightening direction further includes a push plate connected to said actuating lever.

11. The automated tightening and loosening shoe as defined in claim 10, wherein said tightening mechanism further includes a compressible and expansible filler material located between said push plate and an exterior portion of said heel.

12. The automated tightening and loosening shoe as defined in claim 1, wherein said means for advancing said cable in said tightening direction includes a pull tab attached to said cable for pulling said cable to advance said cable in said tightening direction.

13. The automated tightening and loosening shoe as defined in claim 12, wherein said cable is a ratchet cable having a plurality of spaced apart apertures along its length, and wherein said tightening mechanism further includes a pawl having a nose portion for entering into said apertures successively to obstruct reverse movement of said ratchet cable as it is pulled in said tightening direction by said pull tab.

14. The automated tightening and loosening shoe as defined in claim 13, wherein said pawl further has a handle protruding outwardly of said heel for releasing said pawl from an aperture in said ratchet cable to thereby allow reverse movement of said ratchet cable.

15. The automated tightening and loosening shoe as defined in claim 1, wherein said means for advancing said cable in said tightening direction includes both an actuating lever for pushing said cable to advance said cable in said tightening direction and a pull tab attached to said cable for pulling said cable to advance said cable in said tightening direction.

16. The automated tightening and loosening shoe as defined in claim 15, wherein said cable is a ratchet cable having a plurality of spaced apart apertures along its length, and wherein said actuating lever includes a nose portion for entering into said apertures successively to push said ratchet cable in said tightening direction.

17. The automated tightening and loosening shoe as defined in claim 1, and further comprising means for releasing said tightening mechanism, whereby said plurality of polymer bands loosen by their inherent spring memory.

18. The automated tightening and loosening shoe as defined in claim 1, wherein each of said polymer bands crisscrosses across said tongue.

19. The automated tightening and loosening shoe as defined in claim 1, and further comprising springs connected between adjacent polymer bands.

20. The automated tightening and loosening shoe as defined in claim 19, wherein said springs have different lengths and different resiliencies.

21. The automated tightening and loosening shoe as defined in claim 1, wherein the number of polymer bands constituting said plurality of polymer bands is three.

22. The automated tightening and loosening shoe as defined in claim 1, wherein portions of each of said polymer bands reside in slots formed in the material of the shoe on opposite sides of said tongue.

23. The automated tightening and loosening shoe as defined in claim 22, wherein at least one of said slots contains a retracting elastic band having one end connected to the material of the shoe and another end connected to the polymer band residing in that same slot, said retracting elastic band serving to impart a recoiling force to said polymer bands upon release of said tightening mechanism and thereby cause loosening of said polymer bands.

24. The automated tightening and loosening shoe as defined in claim 1, wherein said sole has a chamber provided therein, and wherein each of said polymer bands has a midportion located within said chamber.

25. An automated tightening and loosening shoe comprising:

a. a shoe with a sole, a heel, a toe an upper connected to the sole and having, a lacing pad and a tongue fixed thereto;

b. a chamber formed in said sole;

c. a plurality of slots formed in the material of said shoe on each side of said tongue, each of said slots extending through said lacing pad and opening into said chamber in said sole;

d. a plurality of polymer bands, each having inherent spring memory, crossing said tongue, each of said polymer bands including:

(1) ends connected to said lacing pad on opposite sides of said tongue;

(2) a midportion located in said chamber in said sole; and, (3) portions between each said ends and said midportion residing in respective said slots on each side of said tongue;

e. separate springs connected between said midportions of adjacent polymer bands; and, f. a tightening mechanism located at said heel, said tightening mechanism including a cable connected to the midportion of the polymer band nearest said heel, said cable being advanceable in a tightening direction toward said heel, and said tightening mechanism further including means for advancing said cable in said tightening direction.

* * * * *